US007854537B2

(12) United States Patent
Caluori

(10) Patent No.: US 7,854,537 B2
(45) **Date of Patent: *Dec. 21, 2010**

(54) RECESSED LIGHTING FIXTURE

(75) Inventor: Giuseppe Caluori, Dollard-des-Ormeaux (CA)

(73) Assignee: Canlyte Inc., Lachine (CA)

( * ) Notice: Subject to any disclaimer, the term of this patent is extended or adjusted under 35 U.S.C. 154(b) by 0 days.

This patent is subject to a terminal disclaimer.

(21) Appl. No.: 12/365,913

(22) Filed: Feb. 5, 2009

(65) Prior Publication Data

US 2009/0135615 A1 May 28, 2009

Related U.S. Application Data

(63) Continuation of application No. 11/675,946, filed on Feb. 16, 2007, now Pat. No. 7,549,780.

(60) Provisional application No. 60/774,452, filed on Feb. 17, 2006.

(51) Int. Cl.
*F21S 8/06* (2006.01)

(52) U.S. Cl. ..... 362/404; 362/145; 362/365

(58) Field of Classification Search ..... 362/145, 362/147, 148, 364, 365, 366, 368, 404
See application file for complete search history.

(56) References Cited

U.S. PATENT DOCUMENTS 4,250,540 A * 2/1981 Kristofek ..... 362/368
4,293,895 A * 10/1981 Kristofek ..... 362/147
5,377,088 A * 12/1994 Lecluze ..... 362/366
5,567,041 A * 10/1996 Slocum ..... 362/148
5,609,414 A * 3/1997 Caluori ..... 362/366
7,549,780 B2 * 6/2009 Caluori ..... 362/404

* cited by examiner

*Primary Examiner*—John A Ward

(57) ABSTRACT

A recessed lighting fixture includes a housing having one or more side walls, one or more of which including at least one elongate slot formation, the slot formation including a pair of oppositely extending lateral edge formations, each lateral edge formation having a first dimension, a retaining clip to be located in the slot formation for movement therealong. The retaining clip has a first portion to extend through the slot formation and to travel along an inner surface of the corresponding side wall on opposite sides of the slot formation, a second portion having a second dimension exceeding the first dimension and to travel along an outer surface of a corresponding side wall on opposite sides of the slot formation. The second portion is arranged to be biased outwardly from the housing relative to the first portion, the second portion joined to a third portion, the third portion being arranged to extend through the slot formation in a retained position, in which the third portion is retained against an inner surface of the corresponding lateral edge formation with the second portion in a spring-loaded orientation. The third portion is movable from the retained position to a released position when separated from the lateral edge formation, thereby causing the second portion to be transferred from its spring-loaded orientation to an outwardly extended orientation relative to the housing.

4 Claims, 26 Drawing Sheets

RECESSED LIGHTING FIXTURE

CROSS-REFERENCE TO RELATED APPLICATIONS

The entire subject matter of U.S. application Ser. No. 11/675,946 filed Feb. 16, 2007 and entitled RECESSED LIGHTING FIXTURE is incorporated by reference. The applicants claim priority benefit for this continuation patent application under Title 35, United States Code, Section 120 of U.S. application Ser. No. 11/675,946 filed Feb. 16, 2007 and entitled RECESSED LIGHTING FIXTURE, which claims priority benefit under Title 35, United States Code, Section 119 of U.S. Provisional application Ser. No. 60/774,452 filed Feb. 17, 2006 and entitled RECESSED LIGHTING FIXTURE.

BACKGROUND OF THE INVENTION

1. Field of the Invention

The present invention relates to recessed articles such as lighting fixtures.

2. Description of the Related Art

Recessed light fixtures, often called "pot lights", are in widespread use in residential and commercial premises. They appeal to designers both for the fact that they take up virtually no space in a room, being recessed into the ceiling, and for their aesthetic versatility and appeal.

A typical recessed light fixture comprises a housing, which is usually cylindrical, a socket for receiving a floodlight, halogen bulb or other lamp, and a housing trim for aesthetic purposes which is affixed over the mouth of the housing after the housing has been mounted into the ceiling and covers the housing flange.

An example of a recessed lighting fixture is disclosed in U.S. Pat. No. 5,609,414, issued Mar. 11, 1997, entitled RECESSED LIGHTING FIXTURE, in which a pair of outwardly biased retaining clips is mounted in a housing. The entire subject matter of U.S. Pat. No. 5,609,414, issued Mar. 11, 1997, entitled RECESSED LIGHTING FIXTURE, is incorporated by reference.

While conventional recessed lighting fixtures well serve their intended purpose, they have limited use in some applications. It would be desirable to provide further improvements to such lighting fixtures.

SUMMARY OF THE INVENTION

In one aspect, there is provided a recessed lighting fixture, comprising a housing having one or more side walls, one or more of which including at least one elongate slot formation, the slot formation including a pair of oppositely extending lateral edge formations, each lateral edge formation having a first dimension, a retaining clip to be located in the slot formation for movement therealong, the retaining clip having a first portion to extend through the slot formation and to travel along an inner surface of the corresponding side wall on opposite sides of the slot formation, a second portion having a second dimension exceeding the first dimension and to travel along an outer surface of a corresponding side wall on opposite sides of the slot formation, the second portion being arranged to be biased outwardly from the housing relative to the first portion, the second portion joined to a third portion, the third portion being arranged to extend through the slot formation in a retained position, in which the third portion is retained against an inner surface of the corresponding lateral edge formation with the second portion in a spring-loaded orientation, the third portion being movable from the retained position to a released position when separated from the lateral edge formation, thereby causing the second portion to be transferred from its spring-loaded orientation to an outwardly extended orientation relative to the housing.

In an alternative embodiment, each of the lateral edge formations being provided by a pair of opposed lateral slot extensions.

In an alternative embodiment, the first portion includes a head portion and a neck portion, the neck portion being dimensioned to extend through the slot formation, the head portion arranged to travel along an inner surface of the corresponding side wall on opposite sides of the slot formation.

In an alternative embodiment, the body portion includes a pair of arm portions adjacent the neck portion and extending outwardly therefrom, each arm portion having the second dimension.

In an alternative embodiment, the body portion includes a region with a bend, the arm portions being located on either side of the bend or included therein.

In an alternative embodiment, the third portion has an anchor portion with a retaining section providing a pair of opposed retaining regions, each to engage a corresponding lateral edge formation.

In an alternative embodiment, the third portion includes an anchor portion with a pair of opposed locking flanges, each locking flange being arranged to travel along an inner surface of the corresponding side wall on opposite sides of the slot formation.

An alternative embodiment further comprises a displacement portion for displacing the retaining clip along the slot formation.

In an alternative embodiment, the head portion includes a first passage, the fixture further comprising a mounting flange extending inwardly from a side wall adjacent a corresponding slot formation, the mounting flange including a second passage, the displacement portion including a drive member extending through the first and second passages.

In an alternative embodiment, the anchor portion includes a passage to receive the drive member, the passage being of sufficient dimension to enable the retaining clip to move between the locked and unlocked orientations.

In an alternative embodiment, the drive member is threaded.

In an alternative embodiment, the slot extensions are centrally located along the slot formation.

In an alternative embodiment, the body includes a central elongate passage extending between the arm portions and the anchor portion.

In an alternative embodiment, the head portion includes a pair of contact regions for contacting the inner surface of the corresponding side wall portion, each contact region including a tab.

In an alternative embodiment, the slot extensions include a pair of first boundary edge regions oriented at an angle to one another of less than 180 degrees.

An alternative embodiment further comprises a second boundary region between the first boundary regions, the second boundary region being substantially parallel with a neighbouring boundary edge region of the slot formation.

In an alternative embodiment, the slot extension forms a triangularly shaped opening.

In an alternative embodiment, the body and anchor portions are joined at an offset connecting portion.

In an alternative embodiment, the housing has a back wall, the one or more side walls extending from the back wall, and at least one lower lip extending outwardly from one of said side walls.

In an alternative embodiment, the lip is integrally formed with the corresponding side wall.

In another alternative aspect, there is provided a recessed lighting fixture, comprising housing means providing at least one side wall including at least one elongate slot formation extending therealong, the slot formation including a pair of oppositely extending lateral edge formations, each lateral edge formation having a first dimension, retaining means to be located in the slot formation for movement therealong, the retaining means having a first portion to extend through the slot formation and to travel along an inner surface of the corresponding side wall on opposite sides of the slot formation, a second portion having a second dimension exceeding the first dimension and to travel along an outer surface of a corresponding side wall on opposite sides of the slot formation, the second portion being arranged to be biased outwardly from the housing means relative to the first portion, the second portion joined to a third portion, the third portion being arranged to extend through the slot formation in a retained position, in which the third portion is retained against an inner surface of the corresponding lateral edge formation with the second portion in a spring-loaded orientation, the third portion being movable from the retained position to a released position when separated from the lateral edge formation, thereby causing the second portion to be transferred from its spring-loaded orientation to an outwardly extended orientation relative to the housing.

In another alternative aspect, there is provided a method for mounting a recessed lighting fixture, comprising a. providing a housing with a back wall, one or more side walls extending from the back wall and at least one lower lip extending outwardly from one of said side walls;

b. providing at least one elongate slot formation in one or more of said side walls, with the slot formation including a pair of oppositely extending lateral edge formations, with the lateral edge formation having a first dimension, c. locating a retaining clip in the slot formation for movement therealong, with the retaining clip having a first portion extending through the slot formation to travel along an inner surface of the corresponding side wall on opposite sides of the slot formation, a second portion having a second dimension exceeding the first dimension and to travel along an outer surface of a corresponding side wall on opposite sides of the slot formation, d. arranging the second portion to be biased outwardly from the housing relative to the first portion, with the second portion joined to a third portion, the third portion extending through the slot formation;

e. retaining the third portion against an inner surface of the corresponding lateral edge formation with the second portion in a spring-loaded orientation;

f. moving the third portion from the retained position to a released position by separating the third portion from the lateral edge formation, thereby causing the second portion to be transferred from its spring-loaded position to an outwardly extended position relative to the housing.

In another alternative aspect, there is provided a method for mounting a recessed lighting fixture, comprising:

a. a step for providing a housing with a back wall, one or more side walls extending from the back wall and at least one lower lip extending outwardly from one of said side walls;

b. a step for providing at least one elongate slot formation in one or more of said side walls, with the slot formation including a pair of oppositely extending lateral edge formations, with the lateral edge formation having a first dimension, c. a step for locating a retaining clip in the slot formation for movement therealong, with the retaining clip having a first portion extending through the slot formation to travel along an inner surface of the corresponding side wall on opposite sides of the slot formation, a second portion having a second dimension exceeding the first dimension and to travel along an outer surface of a corresponding side wall on opposite sides of the slot formation, d. a step for arranging the second portion to be biased outwardly from the housing relative to the first portion, with the second portion joined to a third portion, the third portion extending through the slot formation;

e. a step for retaining the third portion against an inner surface of the corresponding lateral edge formation with the second portion in a spring-loaded orientation;

f. a step for moving the third portion from the retained position to a released position by separating the third portion from the lateral edge formation, thereby causing the second portion to be transferred from its spring-loaded position to an outwardly extended position relative to the housing.

In another alternative aspect, there is provided a recessed lighting fixture, comprising a housing having a back wall and arranged to receive a light source therein, a power supply portion for supplying power to the light source, the power supply portion including a support portion which is mounted adjacent the back wall, the support portion and housing having aligned first and second cable passages to receive a power cable to join the light source with the power supply portion, the support portion being movable between a first position against the back wall and a second position in which a segment of the support portion is displaced from the back wall to permit the power supply portion to be moved relative to the housing during installation at a recessed lighting site, the back wall and the support portions forming an inner region therebetween when the support portion is in the extended position, the support portion including a guide portion arranged to extend into the second cable passage and to at least partially shield the power cable in the inner region, when the support portion is in the second position.

In an alternative embodiment, the support portion has a peripheral edge, the first cable passage being open thereto.

In an alternative embodiment, the first support portion includes a slot extending between the first cable passage and the peripheral edge.

In an alternative embodiment, the support portion includes a support plate with the first cable passage formed in a central region thereof, the support plate being fixed near one end to the back wall.

In an alternative embodiment, the support plate includes a first pair of fastener passages at a first location and a second pair of fastener passages at a second location, the first and second fastener passages arranged to receive fasteners therethrough.

In an alternative embodiment, the power supply portion includes a junction box portion, a pair of first fasteners fixing the support plate to the back wall at the first location and a pair of second fasteners for fixing the support plate to the junction box portion.

In an alternative embodiment, the first cable passage has a boundary, the guide member including a flange extending inwardly from the boundary and toward the second cable passage.

In an alternative embodiment, the flange extends partway along the boundary of the first cable passage.

In an alternative embodiment, the boundary extends about 180 degrees along the boundary.

In an alternative embodiment, the guide member has a neck portion with a v shaped cross section.

In an alternative embodiment, the second passage has a peripheral region and a v-shaped notch therein to receive the neck region when the support portion is in the rest position.

In another alternative aspect, there is provided a mounting device for mounting an article in passage formed in a wall panel, comprising a housing having one or more side walls, one or more of which including at least one elongate slot formation, the slot formation including a pair of oppositely extending lateral edge formations, each lateral edge formation having a first dimension, a retaining clip to be located in the slot formation for movement therealong, the retaining clip having a first portion to extend through the slot formation and to travel along an inner surface of the corresponding side wall on opposite sides of the slot formation, a second portion having a second dimension exceeding the first dimension and to travel along an outer surface of a corresponding side wall on opposite sides of the slot formation, the second portion being arranged to be biased outwardly from the housing relative to the first portion, the second portion joined to a third portion, the third portion being arranged to extend through the slot formation in a retained position, in which the third portion is retained against an inner surface of the corresponding lateral edge formation with the second portion in a spring-loaded orientation, the third portion being movable from the retained position to a released position when separated from the lateral edge formation, thereby causing the second portion to be transferred from its spring-loaded orientation to an outwardly extended orientation relative to the housing.

In another alternative aspect, there is provided a recessed lighting fixture, comprising a housing having a back wall, one or more side walls extending from the back wall and at least one lower lip extending outwardly from one of said side walls, one or more of said side walls including at least one elongate slot formation extending along an axis substantially perpendicular to the back wall, the slot formation including a pair of oppositely extending lateral slot extensions, each slot extension having a first dimension, a retaining clip to be located in the slot formation for movement therealong, the retaining clip having a head portion, a neck portion and a body portion, the neck portion being dimensioned to extend through the slot formation and the head portion arranged to travel along an inner surface of the corresponding side wall on opposite sides of the slot formation, the body portion including a pair of arm portions adjacent the neck portion and extending outwardly therefrom, each arm portion having a second dimension exceeding the first dimension to permit the flange portions to travel along an outer surface of a corresponding side wall and over the corresponding lateral slot extension, the body portion arranged to be biased outwardly from the housing, the body portion joined to an anchor portion, the anchor portion being arranged to extend through the slot formation, the anchor portion including a pair of opposed locking flanges, each locking flange being arranged to travel along an inner surface of the corresponding side wall on opposite sides of the slot formation, the locking flanges being dimensioned to pass through a corresponding slot extension to transfer the clip between locked and unlocked orientations.

In another alternative aspect, there is provided a recessed lighting fixture, comprising a housing having a back wall, one or more side walls extending from the back wall and at least one lower lip extending outwardly from one of said side walls, one or more of said side walls including at least one elongate slot formation extending along the back wall, the slot formation including a pair of oppositely extending lateral edge formations, each lateral edge formation having a first dimension, a retaining clip to be located in the slot formation for movement therealong, the retaining clip having a first portion which is dimensioned to extend through the slot formation and to travel along an inner surface of the corresponding side wall on opposite sides of the slot formation, a second portion having a second dimension exceeding the first dimension and arranged to travel along an outer surface of a corresponding side wall on opposite sides of the slot formation, the second portion being arranged to be biased outwardly from the housing relative to the first portion, the second portion joined to a third portion, the third portion being arranged to extend through the slot formation and arranged to be retained against an inner surface of the corresponding lateral edge formation with the second portion is a spring loaded orientation, the third portion being moveable from the retained position to a released position when separated from the lateral edge formation, thereby causing the second portion to be transferred from its spring-loaded position to an outwardly extended position relative to the housing.

In another alternative aspect, there is provided a recessed lighting fixture, comprising a housing having a back wall, one or more side walls extending from the back wall and at least one lower lip extending outwardly from one of said side walls, one or more of said side walls including at least one elongate slot formation extending along an axis substantially perpendicular to the back wall, the slot formation including a pair of oppositely extending lateral slot extensions, each slot extension having a first dimension, a retaining clip to be located in the slot formation for movement therealong, the retaining clip having a head portion, a neck portion and a body portion, the neck portion being dimensioned to extend through the slot formation and the head portion arranged to travel along an inner surface of the corresponding side wall on opposite sides of the slot formation, the body portion including a pair of peripheral regions adjacent the neck portion and extending outwardly therefrom, each peripheral region having a second dimension exceeding the first dimension to permit the peripheral region to travel along an outer surface of a corresponding side wall and over the corresponding lateral slot extension, the body portion arranged to be biased outwardly from the housing, the body portion joined to an anchor portion, the anchor portion being arranged to extend through the slot formation, the anchor portion including a pair of opposed locking flanges, each locking flange being arranged to travel along an inner surface of the corresponding side wall on opposite sides of the slot formation, the locking flanges being dimensioned to pass through a corresponding slot extension to transfer the clip between locked and unlocked orientations.

In still another alternative aspect, there is provided a method for installing a recessed lighting fixture, comprising:

providing a housing with a back wall and arranged to receive a light source therein;

providing a power supply portion for supplying power to the light source;

providing a support portion for mounting the power supply portion to the housing;

positioning the support portion adjacent the back wall;

providing a first cable passage in the support portion to be aligned with a second cable passage in the housing to receive a power cable therethrough to join the light source with the power supply portion;

arranging the support portion to be movable between a first position against the back wall and a second position in which a segment of the support portion is displaced from the back wall to permit the power supply portion to be moved relative to the housing during installation at a recessed lighting site, forming an inner region between the back wall and the support portion when the support portion is in the extended position; and providing a guide portion arranged to extend into the second cable passage to at least partially shield the power cable in the inner region, when the support portion is in the second position.

In yet another alternative aspect, there is provided a recessed lighting fixture, comprising a housing having a back wall and arranged to receive a light source therein, a power supply portion for supplying power to the light source, the power supply portion including a support portion which is mounted adjacent the back wall, the support portion and housing having aligned first and second cable passages to receive a power cable to join the light source with the power supply portion, the support portion being movable between a first position against the back wall and a second position in which a segment of the support portion is displaced from the back wall to permit the power supply portion to be moved relative to the housing during installation at a recessed lighting site, the back wall and the support portions forming an inner region therebetween when the support portion is in the extended position, a barrier arranged to at least partially interrupt access to the inner region when the support portion is in the second position.

BRIEF DESCRIPTION OF THE DRAWINGS

Several preferred embodiments of the present invention will now be described, by way of example only, with reference to the appended drawings in which.

DESCRIPTION OF THE PREFERRED EMBODIMENTS

Figure 1:
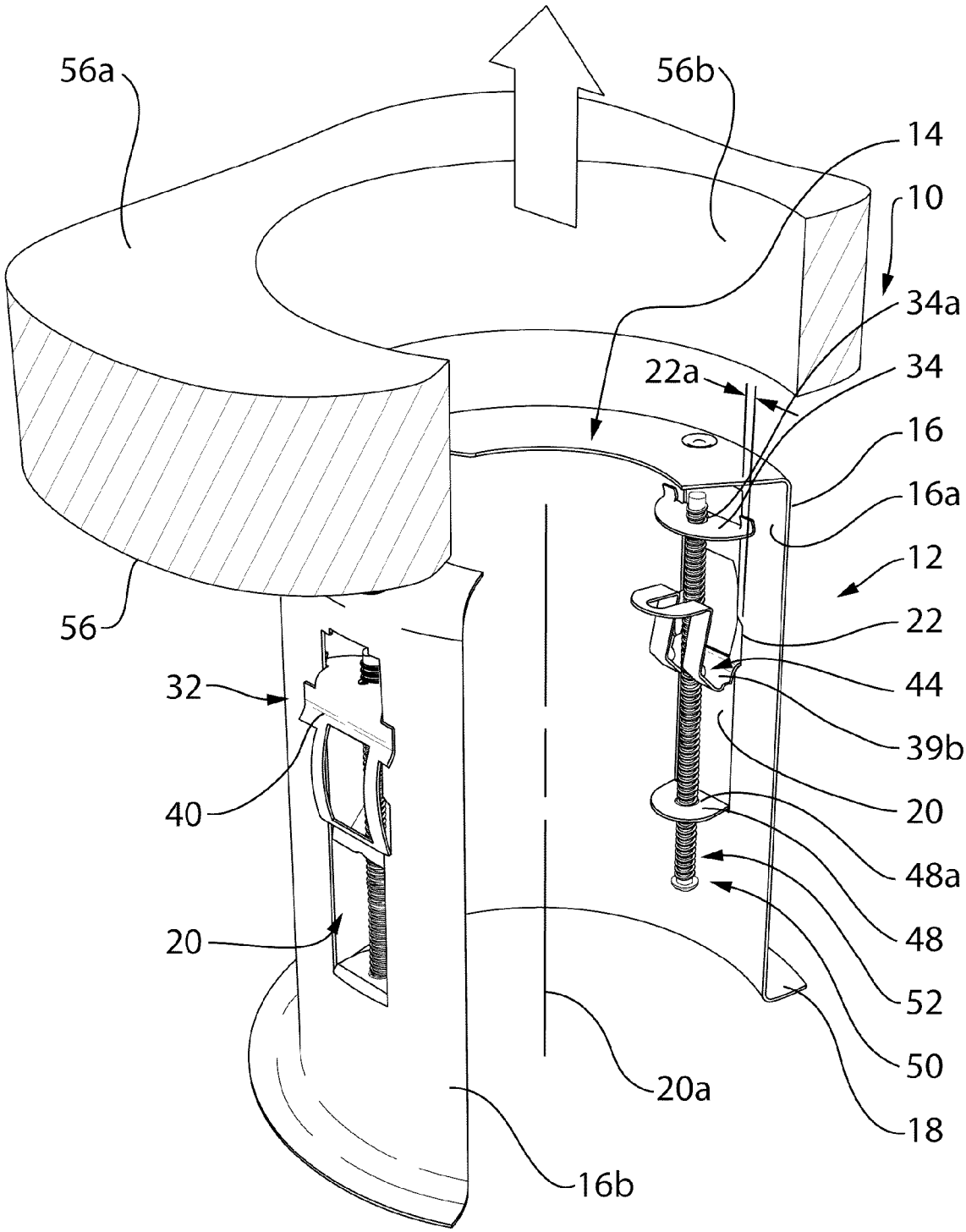
FIG. 1 is a fragmentary perspective view of a housing assembly for a recessed lighting fixture.

FIGS. 1 to 8 show various portions of a recessed article, in this case a recessed lighting fixture 10. The fixture has a housing 12 with a back wall 14 and a cylindrical side wall 16 extending from the back wall 14. A lip 18 extends outwardly from the side wall 16. In this case, the housing 12 is formed of one piece construction, such as by way of a deep drawing manufacturing step.

Located in the side wall is at least one, in this case two elongate slot formations 20 extending along an axis 20*a* substantially perpendicular to the back wall 14. Each slot formation 20 has a pair of oppositely extending lateral edge formations, in the form of slot extensions 22, each slot extension having a first dimension 22*a*.

Figure 2:
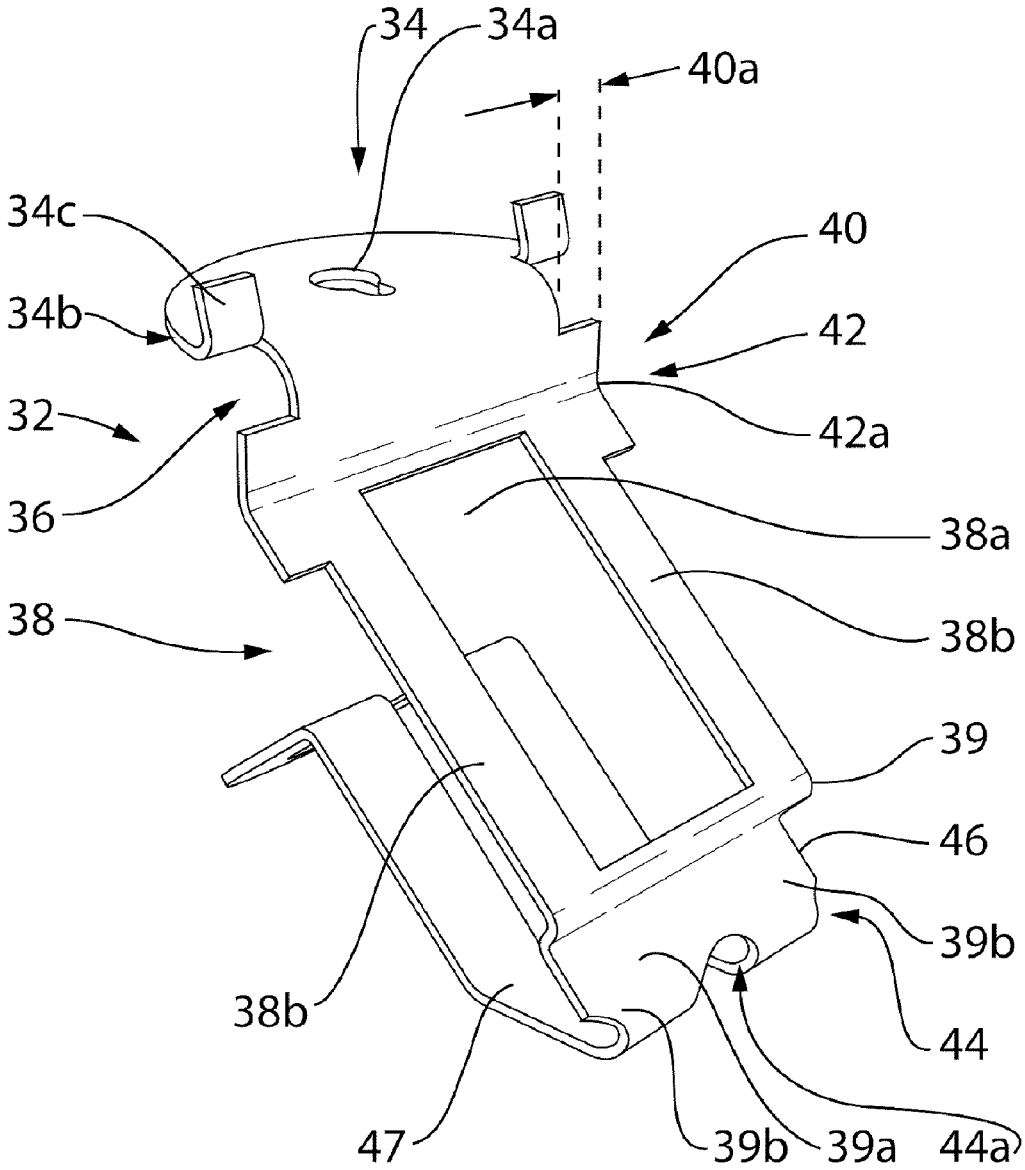
FIG. 2 is a perspective view of a retaining clip used in the housing assembly of FIG. 1.

A retaining clip 32 is located in each slot formation 20 for movement therealong. Referring to FIG. 2, the retaining clip 32 has a first portion including a head portion 34, a neck portion 36, and a second portion in the form of a body portion 38. The neck portion 36 is dimensioned to extend through the slot formation 20, while the head portion 34 is arranged to travel along an inner surface 16*a* of the corresponding side wall 16 on opposite sides of the slot formation 20. The head portion 34 includes a pair of contact regions 34*b* for contacting the inner surface 16*a* of the corresponding side wall 16. In this case, the contact regions are defined by a pair of tabs 34*c*, though the tabs may not be necessary in some examples.

The body portion 38 includes a pair of peripheral regions in the form of arm portions 40 which are adjacent the neck portion 36 and which extend outwardly therefrom. Each arm portion 40 has a second dimension 40*a* exceeding the first dimension 22*a* of the corresponding slot extension 22. This permits each arm portion 40 to travel along an outer surface 16*b* of a corresponding side wall 16 and over the corresponding lateral slot extension 22.

The body portion 38 includes a bend section 42 with a bend 42*a*. In this case, the arm portions 40 are centrally located in the bend section 42. However, other arrangements may be provided in which the arm portions 40 are located either above or below the bend, as desired, with or without a bend section, as desired.

Figure 5:
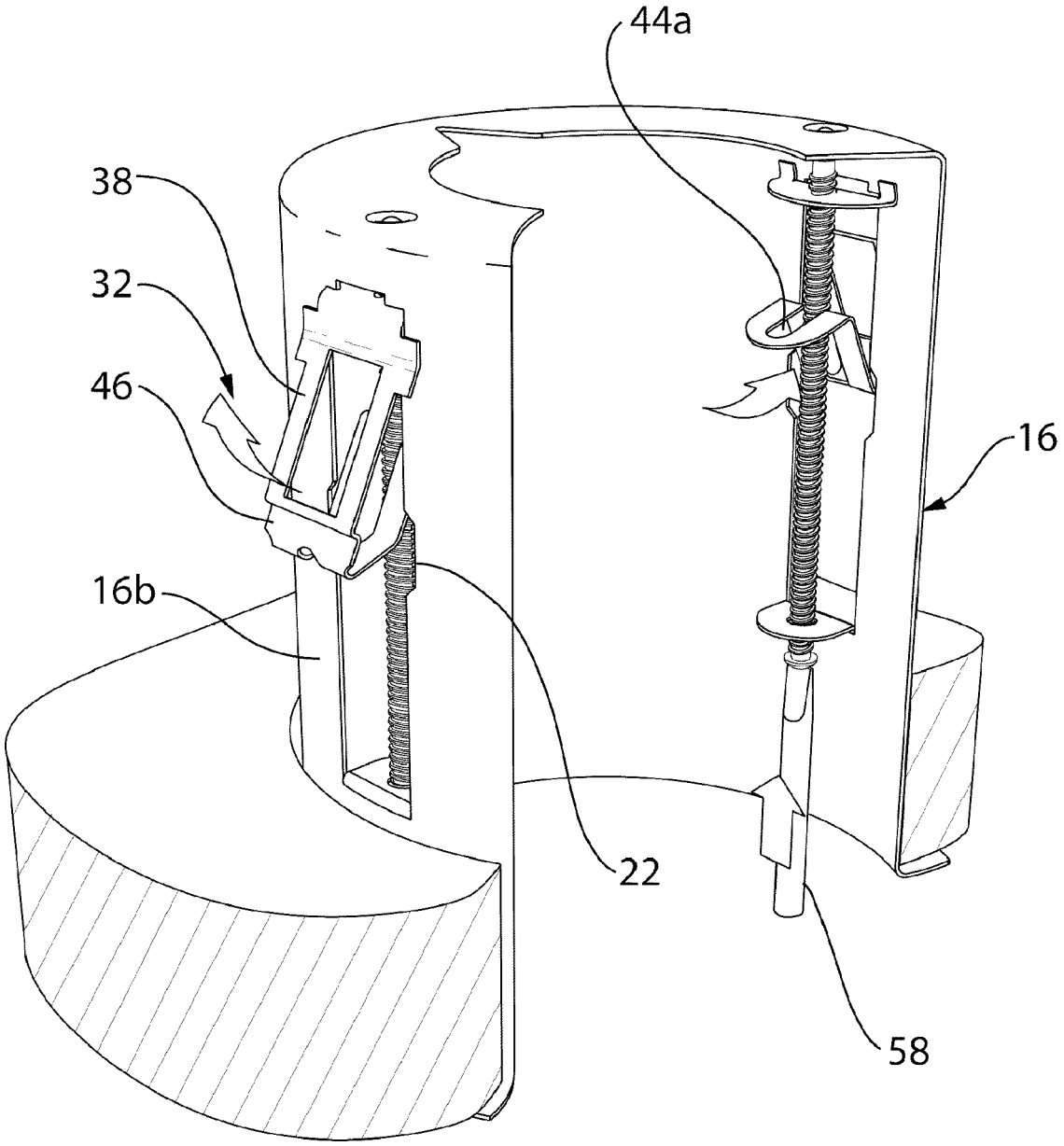
FIGS. 5 to 8 fragmentary perspective views according to FIG. 1 with the housing assembly in different operative positions.

The body portion 38 is arranged to be biased outwardly from the housing 12. The body portion 38 is joined to a third portion in the form of an anchor portion 44, which is arranged to extend through the slot formation 20 and be held in a retained position. As can be seen in FIG. 1, in this retained position, the anchor portion 44 is held against an inner surface 16*a* of the side wall 16 immediately beneath the slot extensions 22, thereby placing the body portion in a spring-loaded orientation, As will be described, the anchor portion 44 is movable from the retained position to a released position as shown in FIG. 5, when displaced upwardly to clear the side wall 16 and thus separated from the slot extensions, thereby causing the body portion to be transferred from its spring-loaded orientation to an outwardly extended orientation relative to the housing 12.

The anchor portion 44 is also provided with a pair of abutment portions shown at 47 to engage an upper surface 56*a* of a ceiling panel as shown at 56 in FIG. 4, as will be described.

A displacement portion 50, including a threaded drive member, in this case screw fastener shown at 52, is provided to displace the clip 32 along the slot formation 20. The head portion 34 includes a first threaded passage 34*a*, for threaded engagement with screw fastener 52. A mounting flange 48 extends inwardly from a side wall 16 adjacent a corresponding slot formation 20 and includes a second passage 48*a*, which, in this case, is a clearance hole, to guide, but not threadably engage, screw fastener 52. The mounting flange 48 may be provided at other locations near the slot 22 or on the housing as desired.

The screw fastener 52 thus extends through the first and second passages 34*a*, and 48*a*. The anchor portion 44 includes a passage 44*a* to receive the screw fastener 52. In this case, the passage 44*a* is of sufficient dimension to enable the retaining clip to move relative to the screw fastener 52 between the locked and unlocked orientations, as can be seen by comparing FIGS. 4 and 5.

Figure 1A:
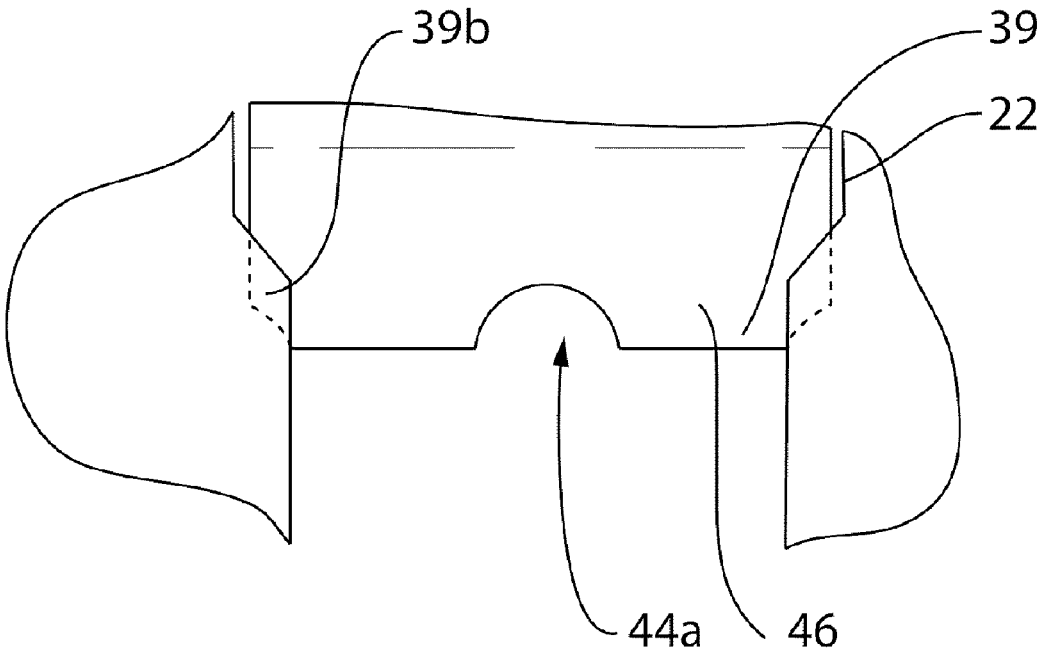
FIG. 1*a* is a fragmentary side view of a portion of the housing assembly of FIG. 1.

The body and anchor portions 38, 44 are joined at an offset connecting portion 39. Located in the offset connecting portion 39 is a retaining section 39*a* providing a pair of retaining regions 39*b*, each to engage a corresponding lateral edge formation, as can be seen in FIG. 1*a*. In this case, the retaining regions 39*b* are on opposite sides of the retaining section 39*a*, though other arrangements may be used, if desired.

Figure 4:
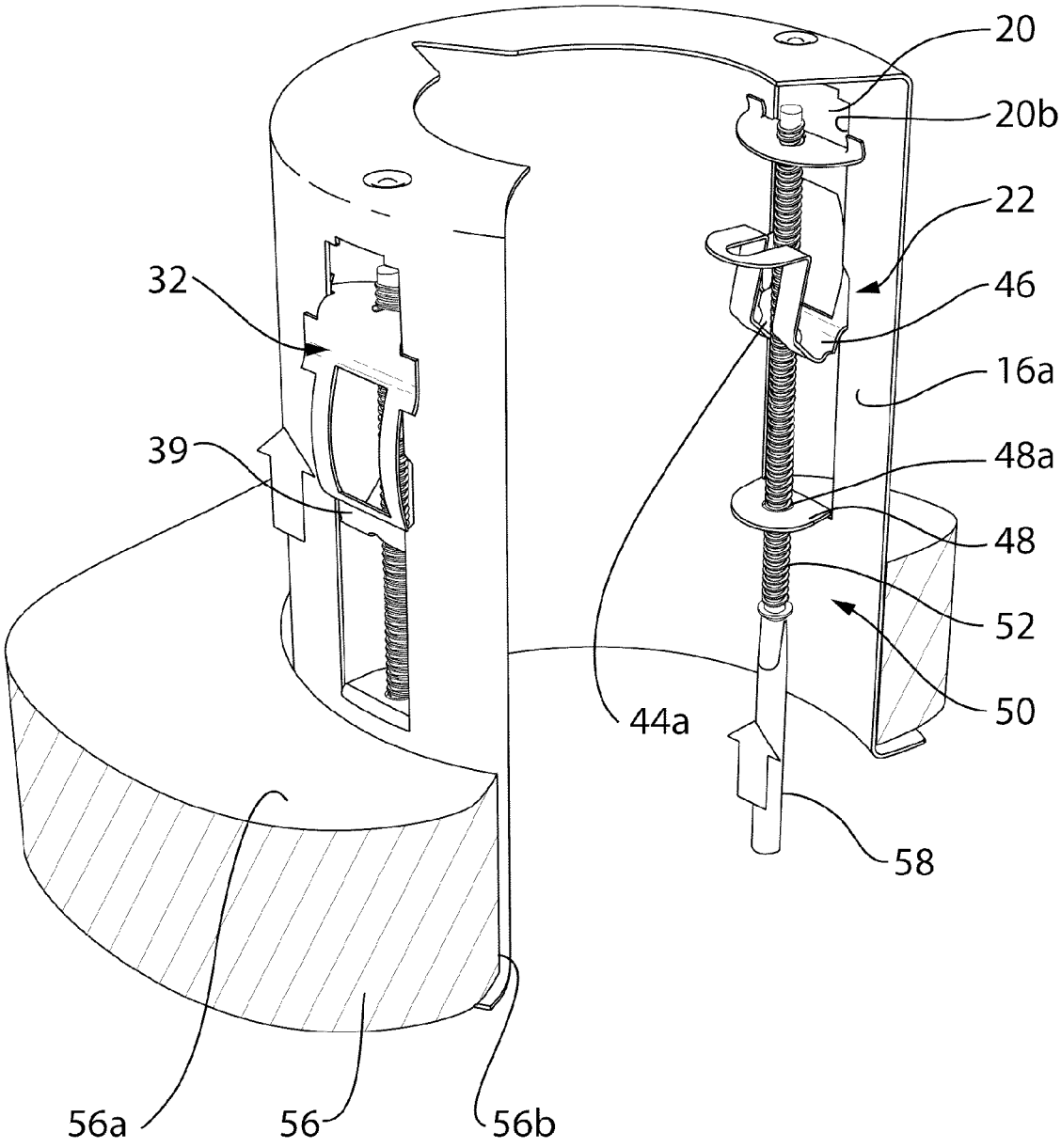
FIG. 4 is fragmentary perspective view according to FIG. 1 with the housing assembly in a different operative position.
Figure 4A:
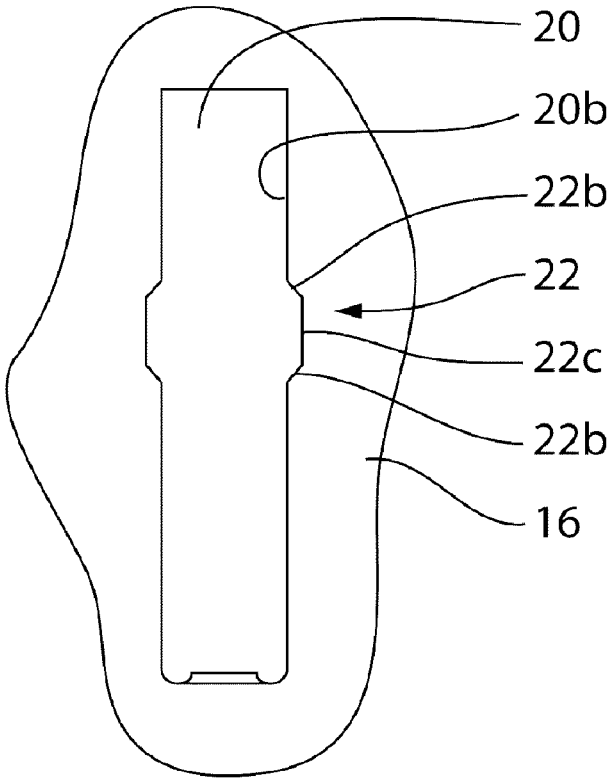
FIG. 4*a* is a side view of a portion of the housing assembly of FIG. 1.

As can be seen in FIGS. 4 and 4*a*, the slot extensions 22 are centrally located along the slot formation 20. However, the slot extensions 22 may be in other locations along the slot formations 20, as desired. The slot extension includes a pair of first boundary edge regions 22*b* oriented at an angle to one another of less than 180 degrees and a second boundary region 22*c* therebetween. The second boundary region 22*c* is, in this case, substantially parallel with a neighbouring boundary edge region 20*b* of the slot formation 20.

Figure 4B:
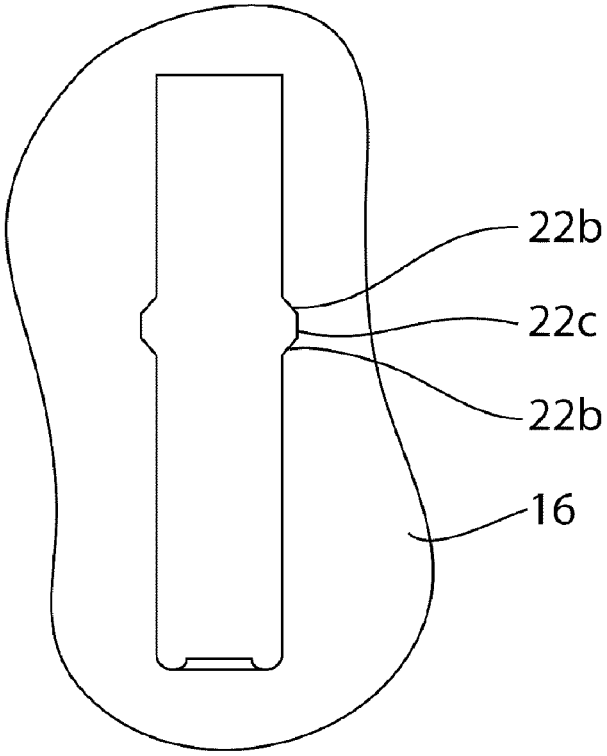
FIG. 4*b* is a side view of a portion of an alternative housing assembly, according to FIG. 4*a;*

However, if desired, the slot extension 20 may form other shaped openings, such as a substantially triangularly shaped opening, as is shown in FIG. 4*b*. In this case, the slot extension has a relatively small second boundary region 22*c* (as in FIG. 4*b*) or no second boundary region. The slot extensions may be provided in other configurations, if desired.

Referring to FIG. 2, the body portion 38 has a central elongate passage 38*a* laterally bounded by a pair of body segments 38*b*. The size of the central elongate passage 38*a* may be selected to vary the characteristics of the retaining clip 32. For instance, the smaller and/or narrower the passage 38*a*, the larger the body segments 38*b*, resulting in a stiffer retaining clip 32.

Figure 2A:
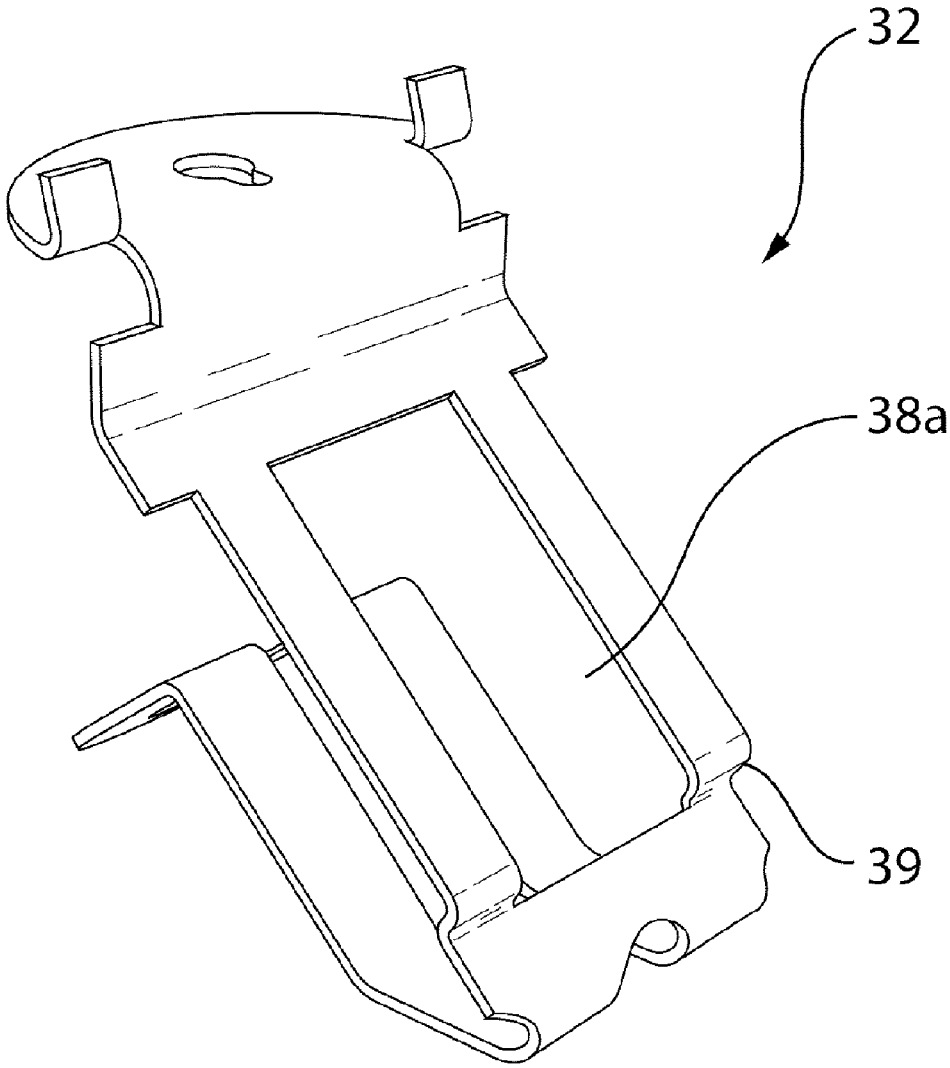
FIG. 2*a* is a perspective view of an alternative retaining clip to that shown in FIG. 2.
Figure 3:
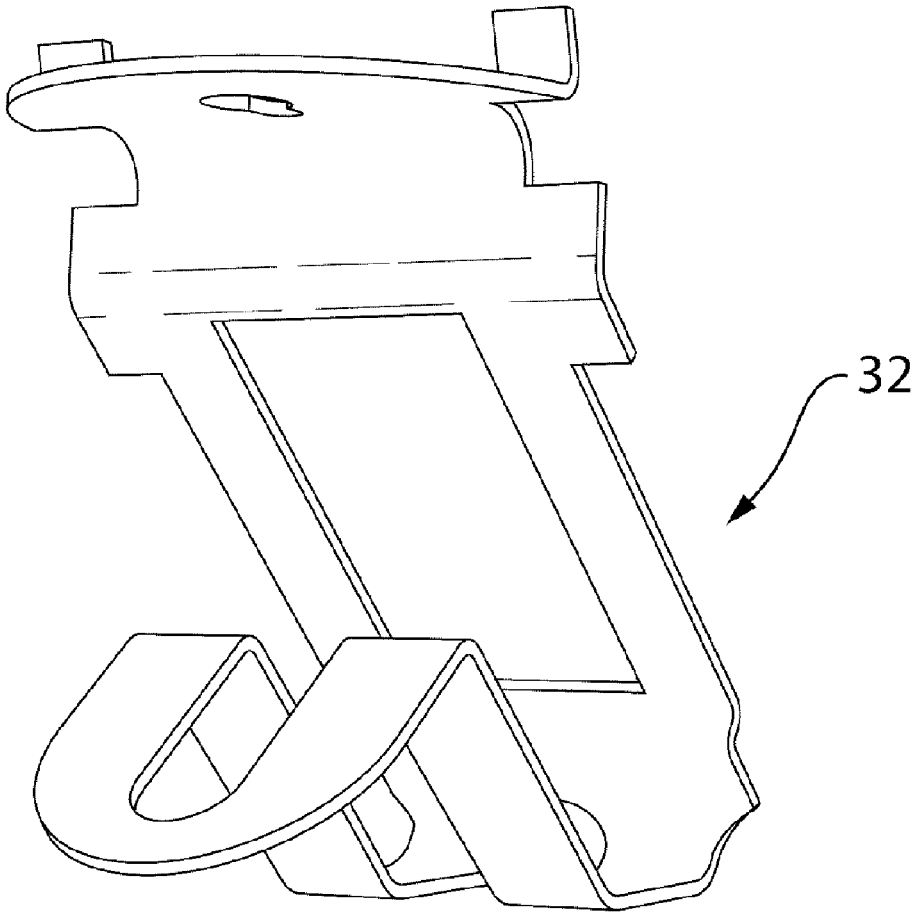
FIG. 3 is another perspective views of a retaining clip of FIG. 2.

An alternative clip is shown at 32 in FIG. 2*a* with an enlarged central elongate passage 38*a* which extends into the offset connecting portion 39.

Figure 7:
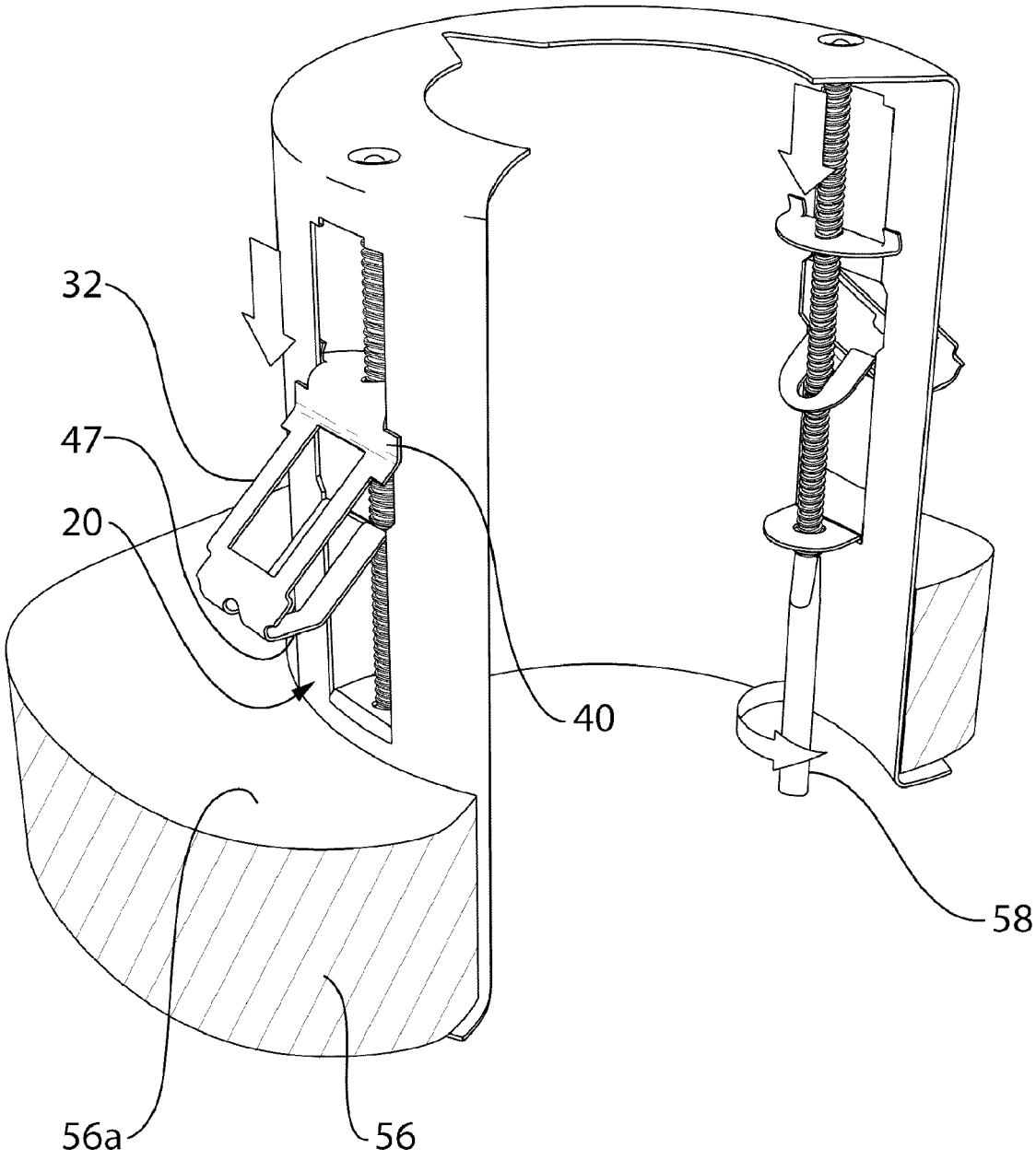
Figure 8:
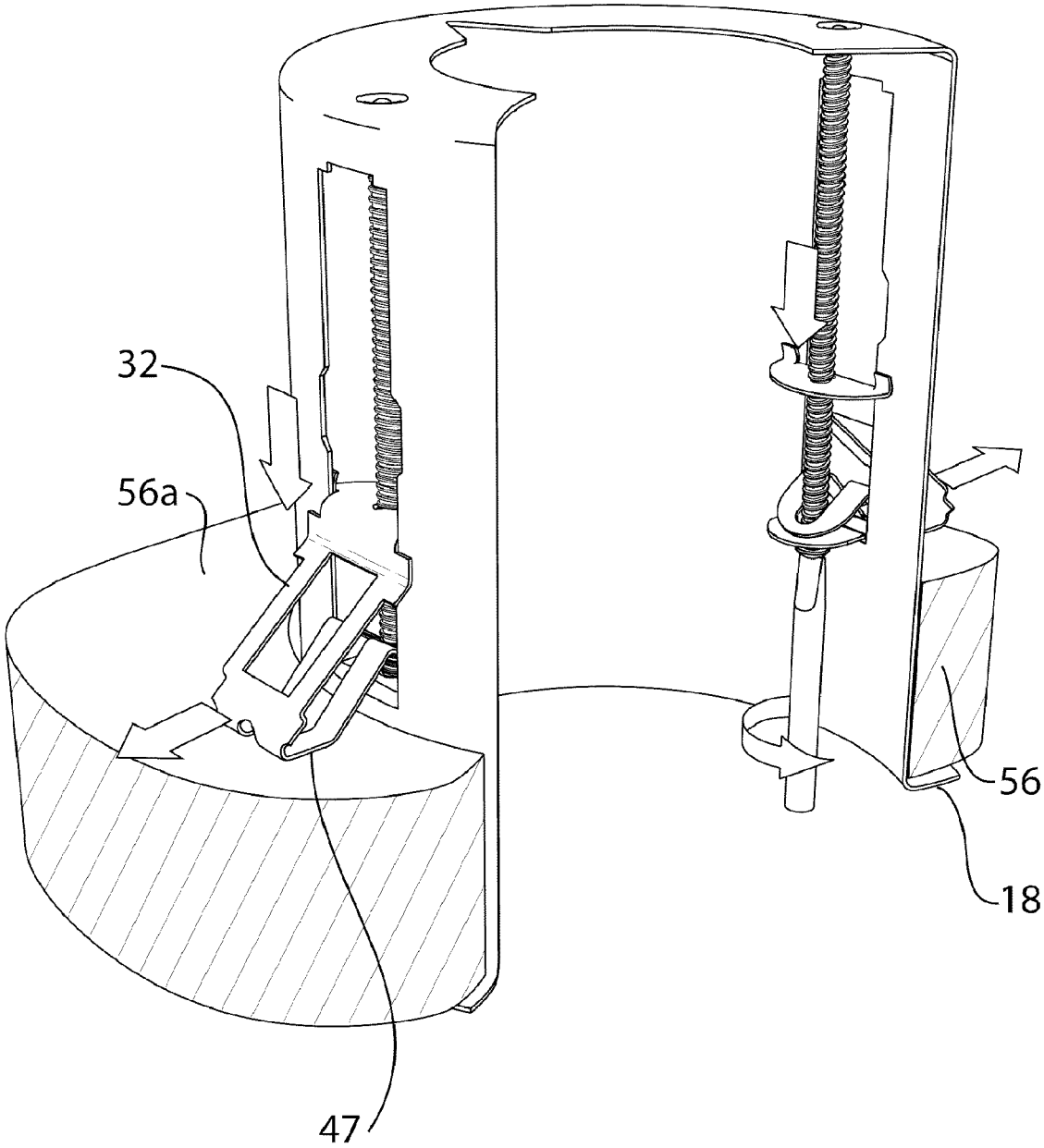

It will thus be seen that the screw fastener 52 may be used to locate and/or displace the retaining clip 32 relative to one or more of:

a. a first phase as shown in FIGS. 1, 1*a* and 4, in which the anchor portion 44 is adjacent the slot extensions. In this case, the retaining regions 39*b* are positioned against the lower boundary regions 22*b* on an inner surface 16*a* of the corresponding side wall 16 on opposite sides of the slot formation 20, the retaining clip 32 is in the locked orientation and the body portion is positioned alongside the outer surface 16*b* of the corresponding side wall 16. In this first phase, the body portion 38 is slightly bowed in light of its spring-loaded orientation;

b. a second phase as shown in FIG. 5 in which the retaining clip is in the released position with the body portion 38 sprung outwardly from the corresponding side wall 16;

c. a third phase as shown in FIG. 7 in which the retaining clip 32 is midway along the slot formation 20 with the arm portions 40 passing over the slot extensions 20;

d. a fourth position as shown in FIG. 8 in which the retaining clip 32 is in the unlocked orientation and a portion of the body portion 38 and/or the abutment portions 47 are to lie against the surface 56*a* of the ceiling panel shown at 56, which itself is positioned against the lip 18; and e. a fifth position, again as shown in FIG. 8, in which the abutment portions 47 are to be drawn relatively tightly towards the lip 18 to brace against the upper surface 56*a* of ceiling panel 56 to hold the fixture in place.

The passage 44*a* in the anchor portion 44 receives the screw fastener 52. In this way, the fastener 52 is able in this instance to act as an anchor or restraining portion to restrain or limit the lateral travel of the clip outwardly from the housing in the fifth position. This occurs because the innermost region of the clip closes the passage 44*a* and the screw abuts this outermost region as the clip is drawn relatively tightly toward the lip 18. While the screw fastener in this case serves as a restraining portion, the anchor portion 44 may be provided with other formations, such as laterally extending flanges extending outwardly from the innermost region of the clip to engage the inner surface of the side wall rather than the screw. Moreover, the anchor portion may be provided with a structure similar to the head portion 34 at its lower end to provide means of limit outward travel of the clip relative to the housing. If desired, each of the lateral edge formations may be provided by other arrangements, such as by a pair of opposed tabs extending into the slot formation 20 from a slot periphery, rather than by the opposed slot extensions 22 shown above.

The recessed lighting fixture 10 may be installed in the following manner. First a passage 56*b* is formed in the ceiling panel 56 as shown in FIG. 1. That being said, the recessed lighting fixture may also be useful for installations in a wall panel or floor panel, if desired. The recessed lighting fixture 10 is then prepared with the appropriate lighting wiring harness to receive a light source, not shown.

Figure 6:
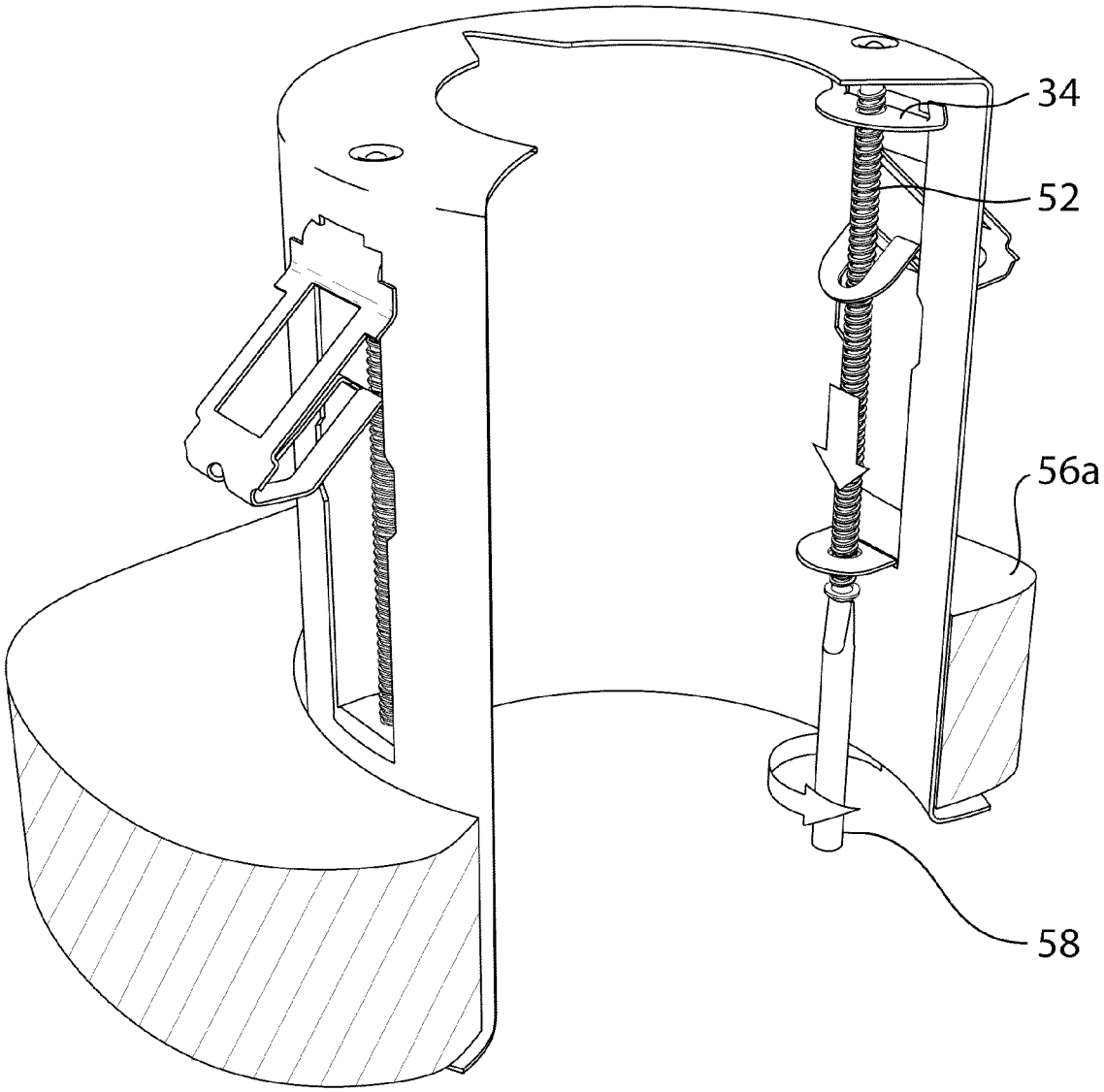

The retaining clips 32 are held in the above mentioned first phase and the housing 10 is pushed through the passage 56*b* to the position as shown in FIG. 4. The user grasps a screw fastener driver shown at 58 and displaces the screw fastener 52 upwardly as shown in FIG. 4, thereby displacing the corresponding retaining clip upwardly. The retaining section 39*a* of the anchor portion slides upwardly sufficiently to release the retaining portions 39*b* from behind the lower boundary regions 22*b*. Thus, as the user continues to displace the driver 58 and hence the retaining clip 32 upward as shown in FIG. 4, to separate it from the lower boundary regions, causing the body portion 38 of the retaining clip 32 to spring outwardly to the released or third position or unlocked orientation in the second phase as shown in FIG. 5. The user then rotates the driver 58 as shown in FIGS. 6 and 7 to draw the retaining clip 32 downward toward the upper surface 56*a* as the head portion 34 progresses along the thread of the fastener 52, eventually causing the abutment portions 47 to abut the upper surface 56*a* as shown in FIG. 8. Continued rotation of the driver 58 thus draws the abutment portions 47 tightly against the upper surface 56*a* to secure the ceiling panel 56 between the abutment portions 47 and the lip 18.

FIGS. 9 to 18 show various portions of another recessed lighting fixture 110. The fixture has a housing 112 with a back wall 114 and a cylindrical side wall 116 extending from the back wall 114. A lip 118 extends outwardly from the side wall 116.

Figure 10:
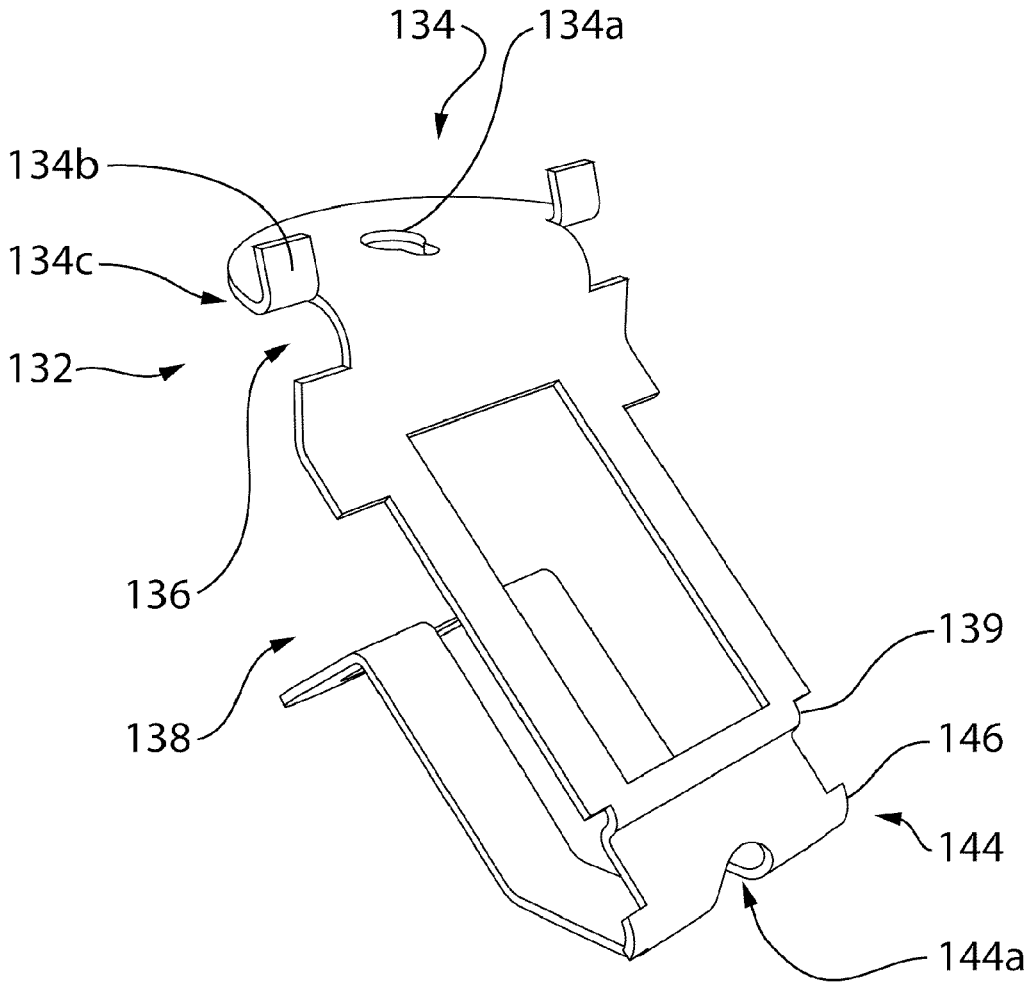
FIGS. 10 and 11 are perspective views of a retaining clip used in the housing assembly of FIG. 9.
Figure 11:
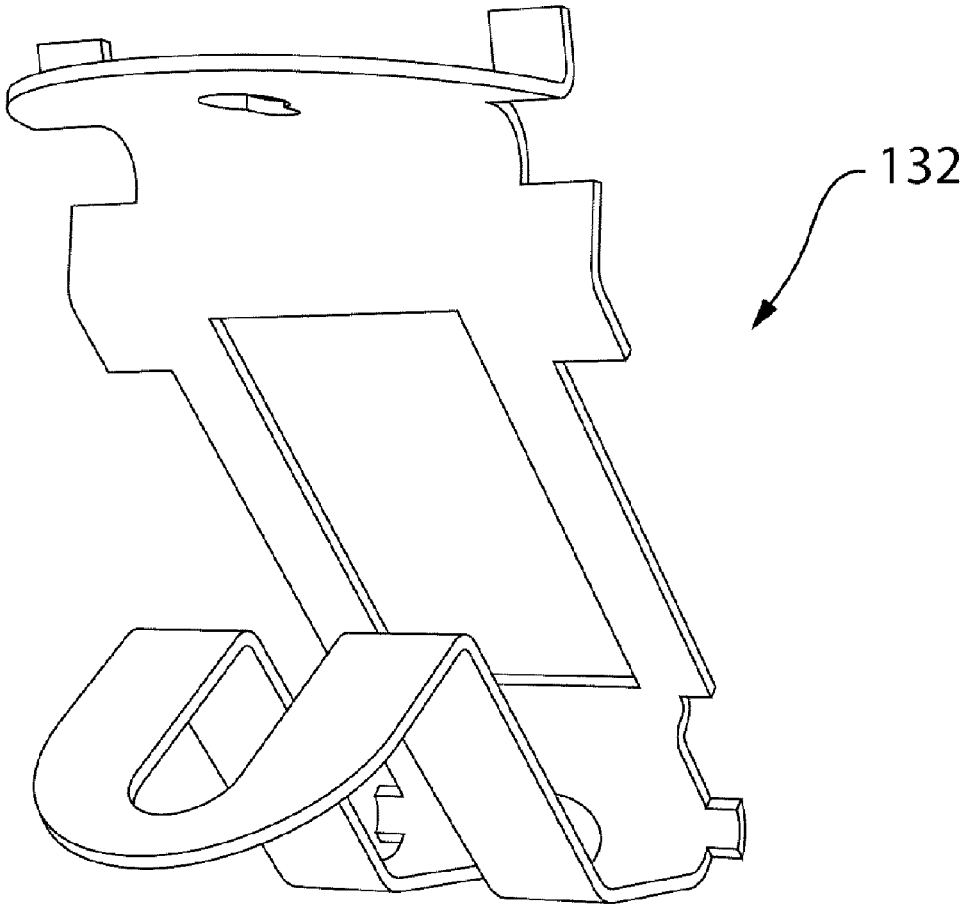

Located in the side wall is at least one, in this case two elongate slot formations 120 extending along an axis 120*a* substantially perpendicular to the back wall 114. Each slot formation 120 has a pair of oppositely extending lateral slot extensions 122, each slot extension having a first dimension 122*a*. A retaining clip 132 is located in each slot formation 120 for movement therealong. Referring to FIG. 10, the retaining clip 132 has a head portion 134, a neck portion 136 and a body portion 138. The neck portion 136 is dimensioned to extend through the slot formation 120, while the head portion 134 has a pair of guide flanges 134*b* on peripheral regions 134*c*. The head portion 134 is thus arranged to travel along an inner surface 116*a* of the corresponding side wall 116 on opposite sides of the slot formation 120.

Figure 9:
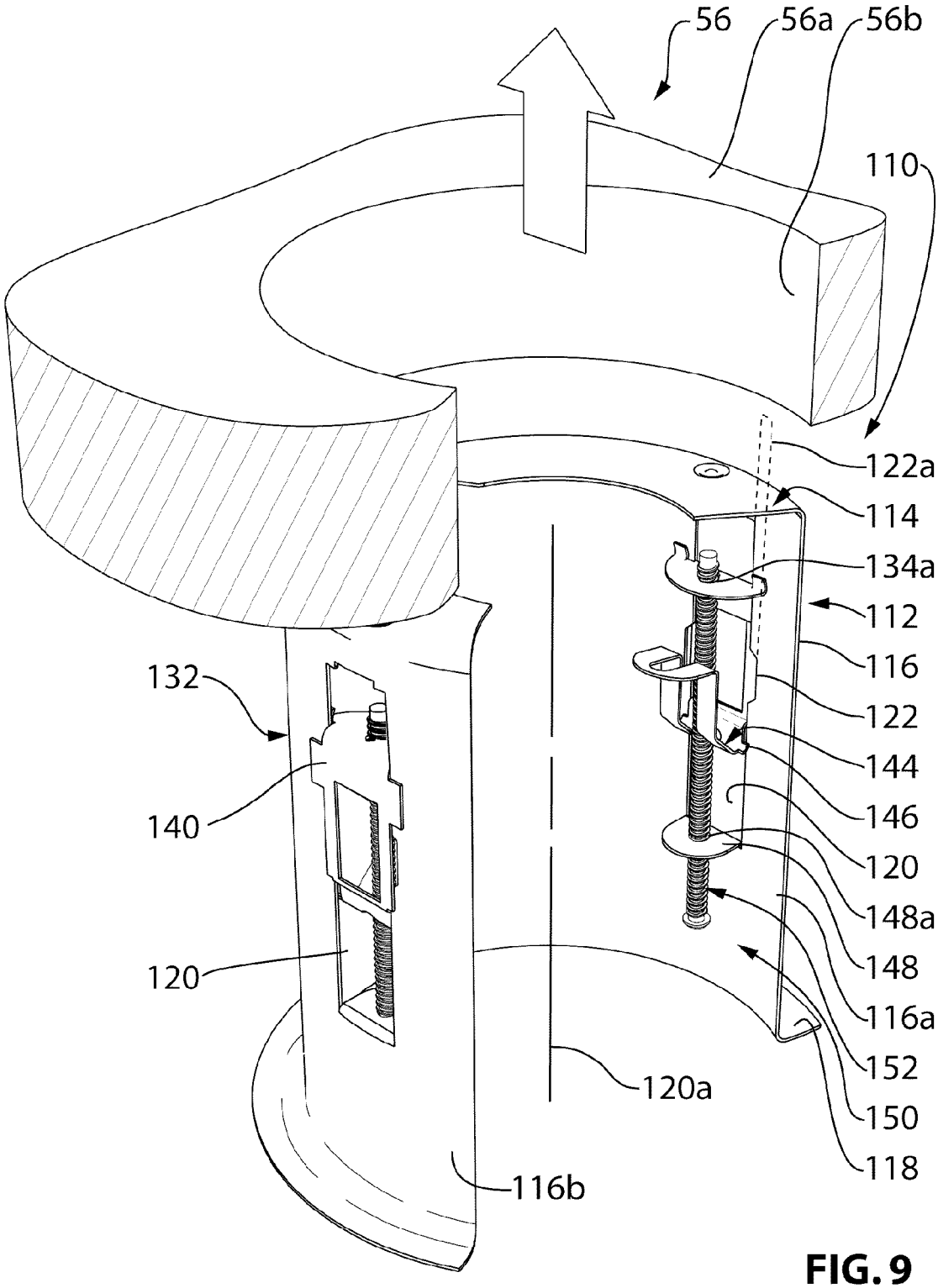
FIG. 9 is a fragmentary perspective view of another housing assembly for a recessed lighting fixture.
Figure 13:
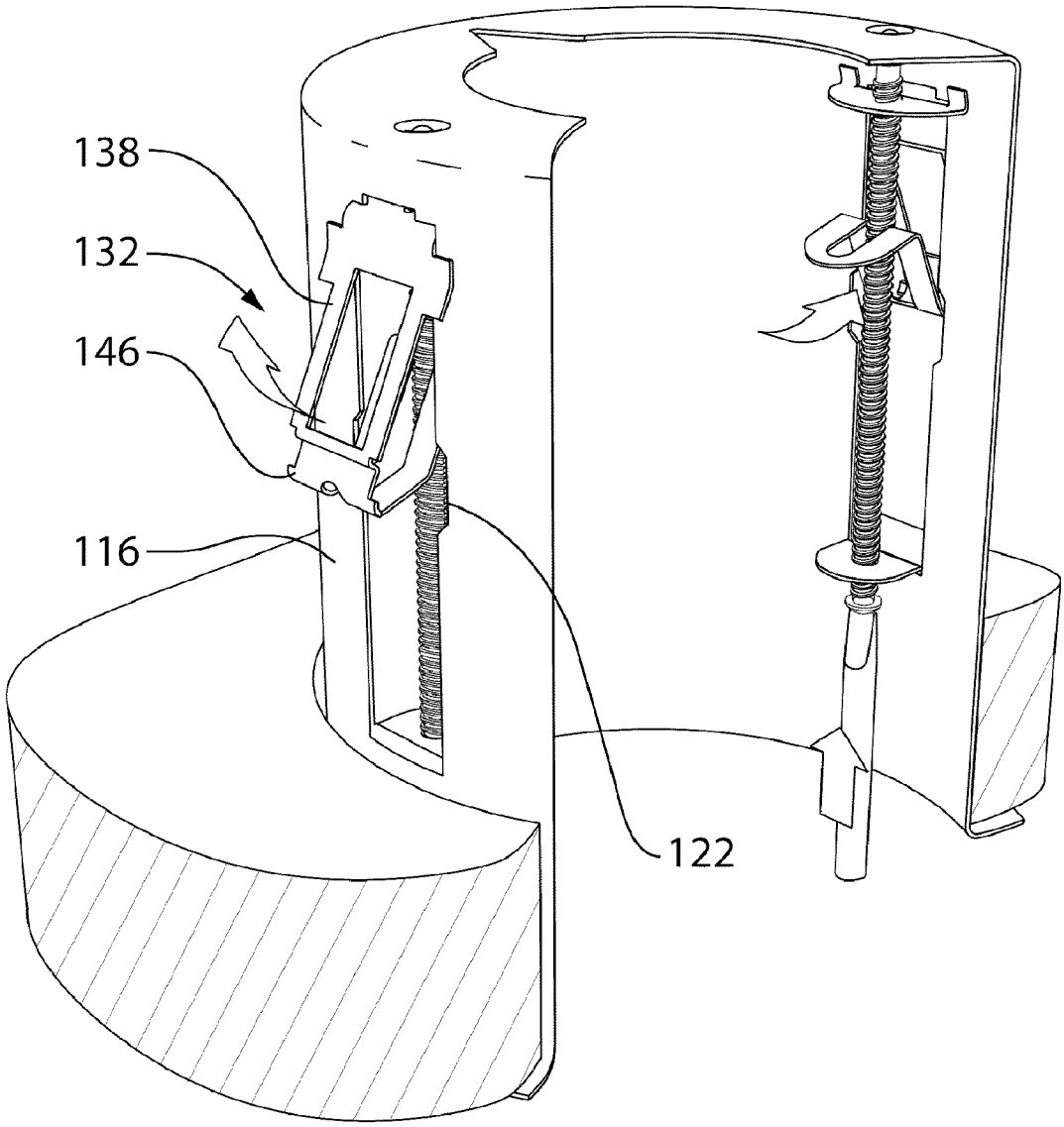

The body portion 138 is arranged to be biased outwardly from the housing 112. The body portion 138 is joined to an anchor portion 144, which is arranged to extend through the slot formation 120. The anchor portion 144 includes a pair of opposed locking flanges 146, each of which travels along the inner surface 116*a* of the corresponding side wall 116 on opposite sides of the slot formation 120. The locking flanges 146 are dimensioned to pass through a corresponding slot extension 122 to transfer the retaining clip 132 between a locked orientation (as shown in FIG. 9) and an unlocked orientation (as shown in FIG. 13).

A displacement portion shown at 150 is provided to displace the clip 132 along the slot formation 120. The head portion 134 includes a first passage 134*a*. A mounting flange 148 extends inwardly from a side wall 116 adjacent a corresponding slot formation 120 and includes a second passage 148*a*.

The displacement portion 150 includes a threaded drive member, in the form of a screw fastener 152, extending through the first and second passages 134*a*, and 148*a*. The anchor portion 144 includes a passage 144*a* to receive the screw fastener 152. In this case, the passage 144*a* is of sufficient dimension to enable the retaining clip to move relative to the screw fastener 152 between the locked and unlocked orientations.

In this case, the body and anchor portions 138, 144 are joined at an offset connecting portion 139. This allows the body portion 138 to lie along the side wall 116 in the locked position, as can be seen in FIG. 9. The body portion 138 is shown in a generally parallel orientation with the side wall 116, while in most cases, there may be some degree of bowing of the retaining clip in light of its spring loaded orientation. However, there may other cases where the spring loaded orientation is such that the flex of the body portion 138 is reduced. Still further, there may be examples in which the retaining clip is not spring-loaded but is otherwise subjected to an outward bias, sufficient to release the retaining clip from the housing.

It will thus be seen that a screw fastener 152 may be used to locate and/or displace the retaining clip 132 relative to one or more of:

a. a phase as shown in FIG. 9, in which the anchor portion 144 is adjacent or near a corresponding mounting flange 148 (or between a relatively lower boundary of the corresponding slot formation 120 and the mounting flange 148). In this position, the locking flanges 146 are positioned on an inner surface 116*a* of the corresponding side wall 116 on opposite sides of the slot formation 120, the retaining clip 132 is in the locked orientation and the body portion is positioned alongside the outer surface 116*b* of the corresponding side wall 116; and b. another phase as shown in FIG. 13 in which the retaining clip 132 is in the unlocked orientation with the body portion 138 sprung outwardly from the corresponding side wall 116 and each locking flange 146 aligned with the corresponding slot extension 122;

The remaining phases are similar to those for the housing 10.

The recessed lighting fixture 110 may be installed in the passage 56*b* formed in the ceiling wall panel 56 in a manner similar to that discussed earlier.

Figure 12:
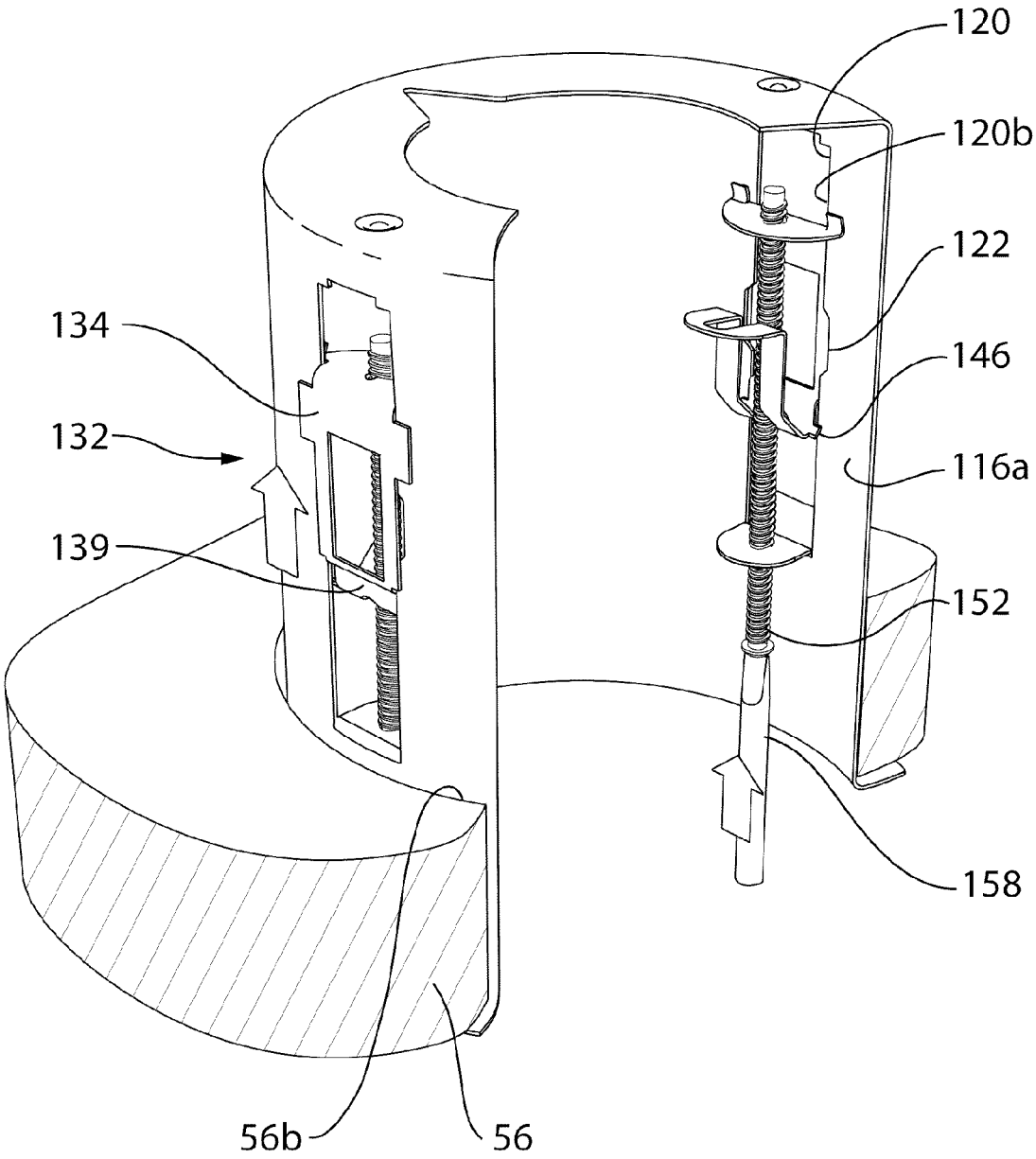
FIGS. 12 and 13 are fragmentary perspective view according to FIG. 9 with the housing assembly in different operative positions.

Thus, as shown in FIG. 9, the retaining clips 132 are held in the above mentioned first phase and the housing 110 is pushed through the passage 56*b* to the position as shown in FIG. 12. The user grasps a screw fastener driver shown at 158 and displaces the screw fastener 152 upwardly as shown in FIG. 12, thereby displacing the corresponding retaining clip 132 upwardly. The locking flanges 146 slide upwardly along the inner surface 116*a* of the side wall 116 as they approach the slot extensions 122. Thus, as the user continues to displace the driver 158 and hence the retaining clip 132 upward, the locking flanges 146 pass into and through the slot extensions causing the body portion 38 of the retaining clip 132 to spring outwardly to the third position in the unlocked orientation as shown in FIG. 13. The user then rotates the driver 158 and continues in the same manner as in the previous example.

Figure 14:
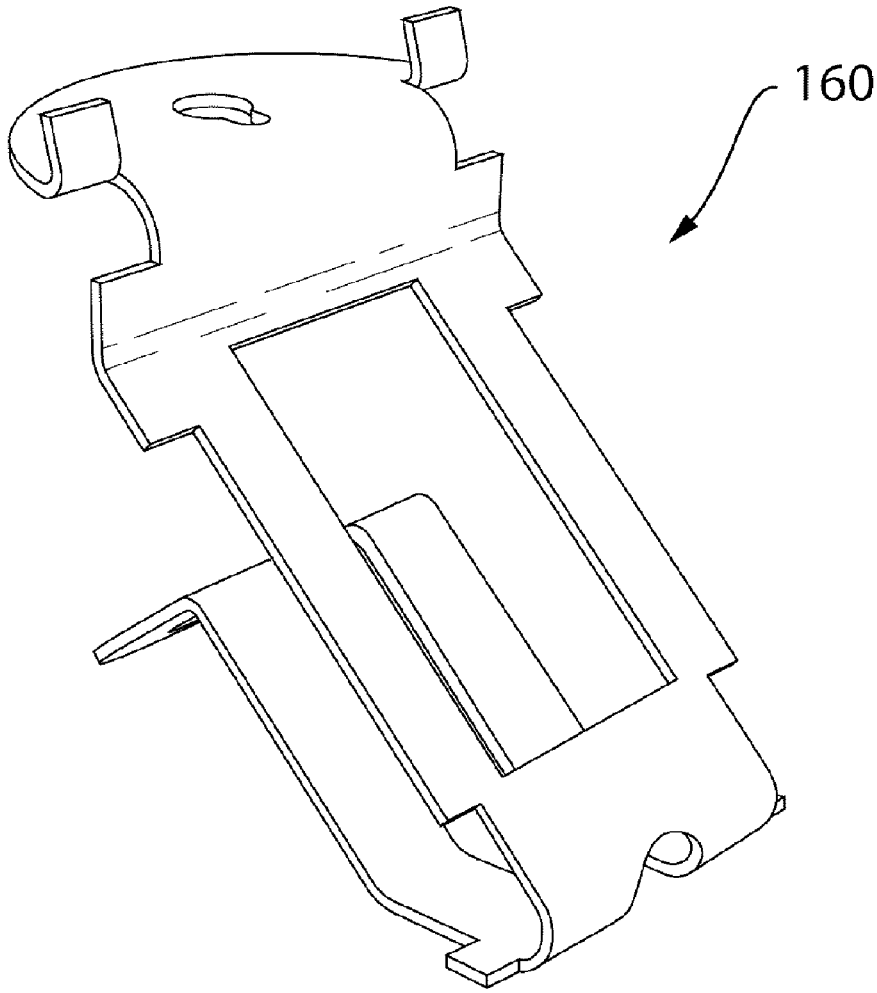
FIGS. 14 to 17 show variations of other retaining clips.
Figure 15:
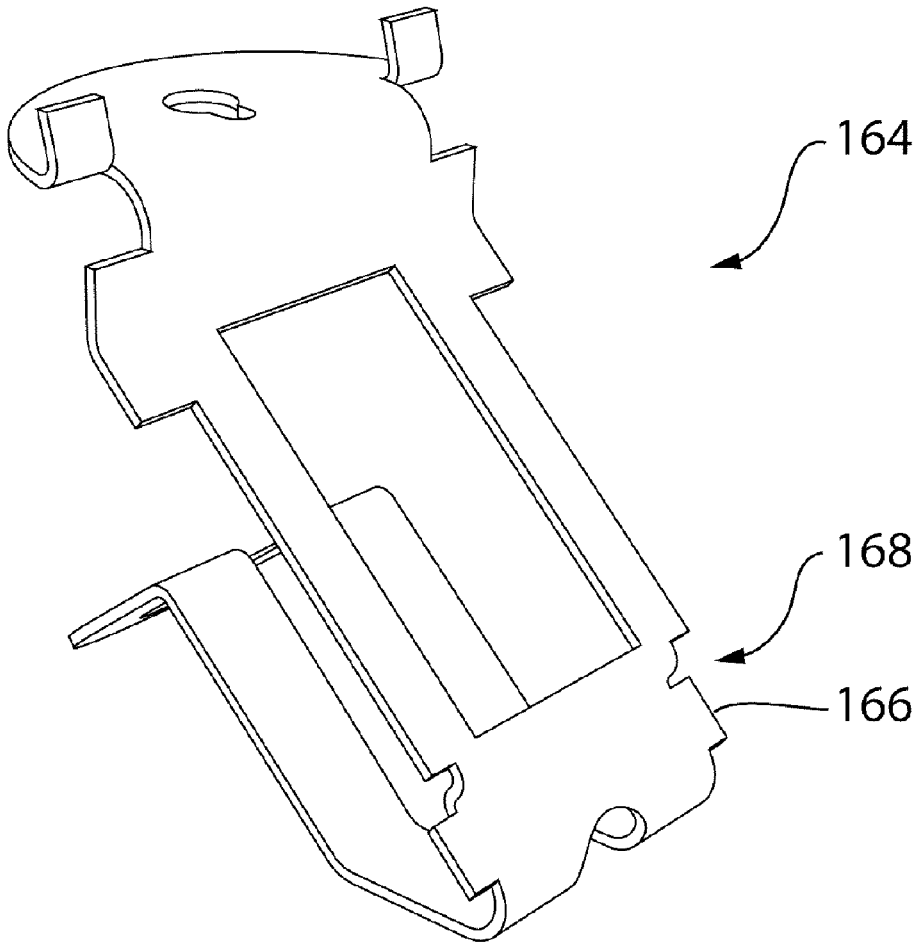
Figure 16:
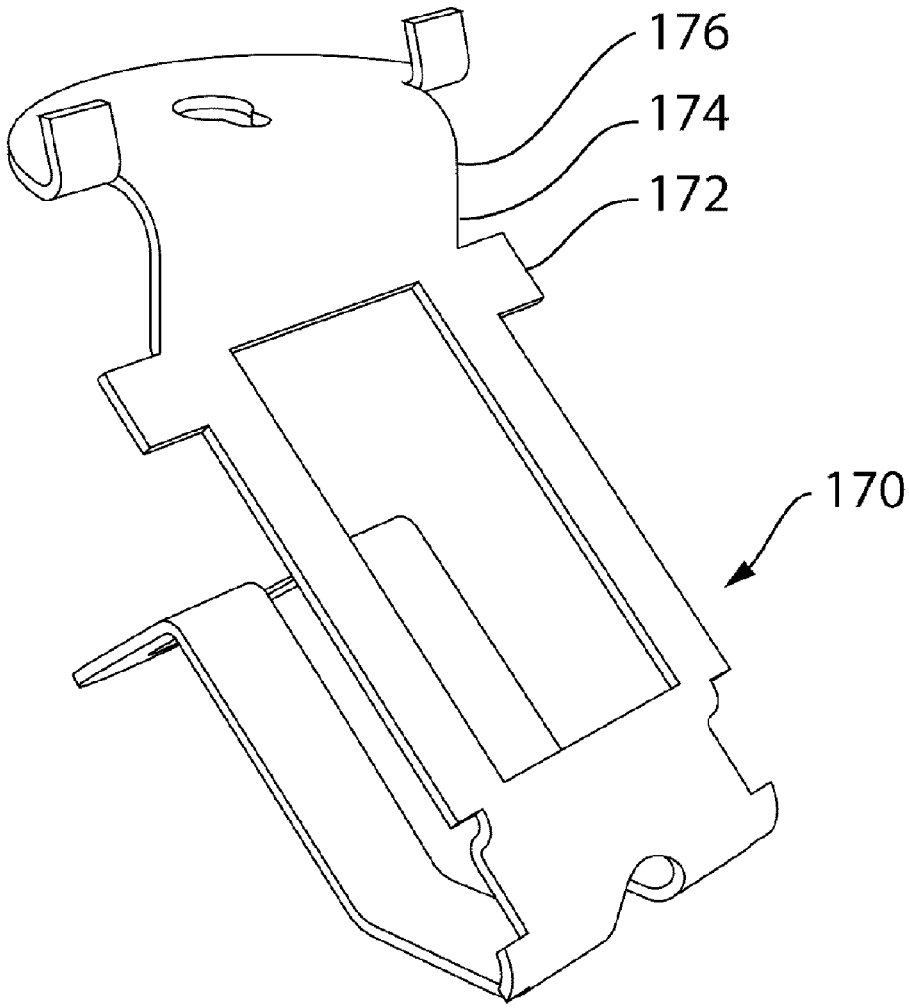
Figure 17:
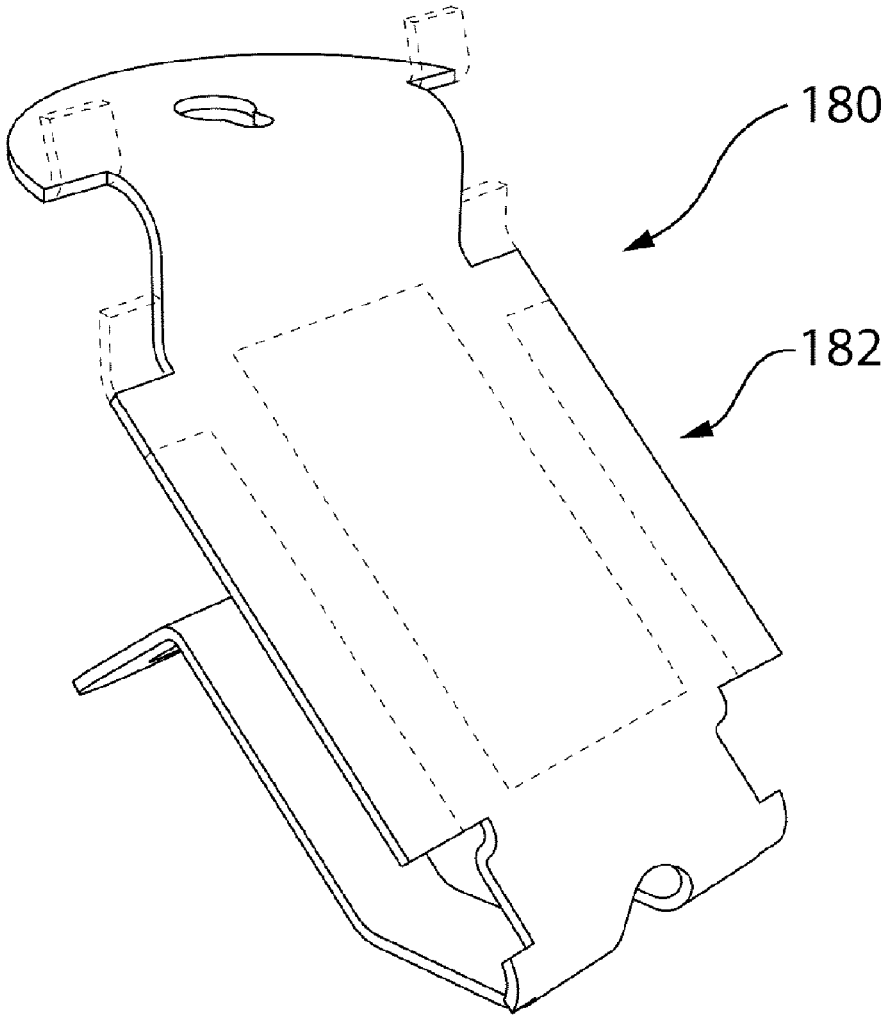

FIGS. 14 through 17 show additional alternative retaining clips. In FIG. 14, a retaining clip is shown at 160 which does not have the offset connecting portion 139 of previous retaining clip 132. In FIG. 15, a retaining clip is shown at 164 which is provided with locking flanges 166 which are located relatively closely to the offset connecting portion 168. In FIG. 16, a retaining clip is shown at 170 which is provided with arm portions 172 which are located below the bend section 174. Otherwise said, the bend section 174 is, in this case, located between a neck portion shown at 176 and the arm portions 172. In FIG. 17, a retaining clip is shown at 180 without the tabs 34*c* of the retaining clip 32. In addition, the arm portions previously shown at 40 in the retaining clip 32 are, in this case, integrated into a relatively wider body portion 182, when compared with the corresponding body portion 38 of retaining clip 32. In addition, the retaining clip 180 does not have the central elongate passage in the body portion 38 of retaining clip 32.

Figure 18:
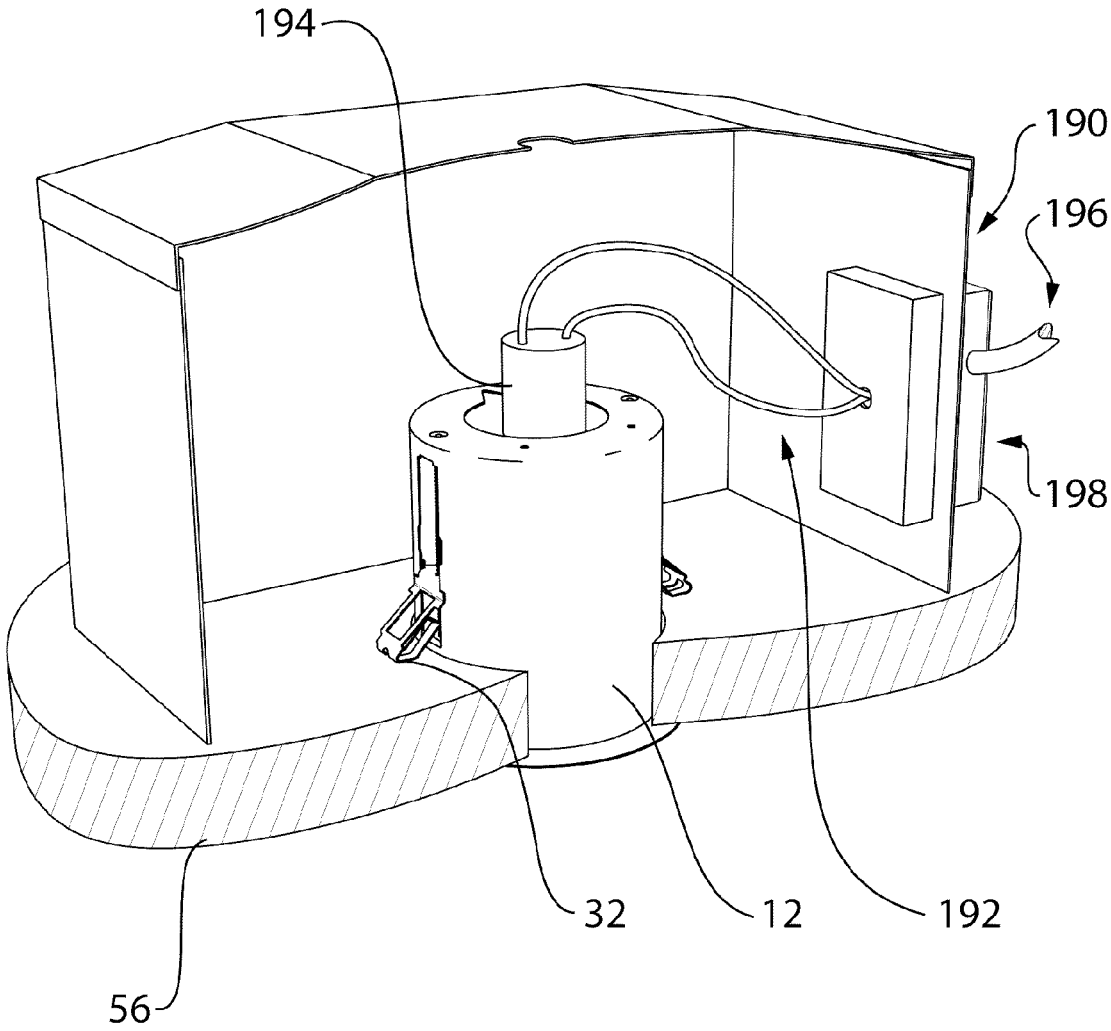
FIG. 18 is a fragmentary perspective view of a recessed lighting fixture.

FIG. 18 shows one example of the recessed lighting fixture 10 which in this case includes the housing 12, the retaining clips 32 and a cowling 190. A lighting wiring harness 192 is provided with a light socket 194 and a junction box 198 is provided to accept the power cables 196. In this case, the cowling may be installed above a ceiling panel 56 prior to or following the installation of the housing 12.

Another recessed lighting fixture is shown at 200 in FIGS. 19 to 22. The recessed lighting fixture 200 is arranged to receive a light source therein and has a power supply portion 202 for supplying power to the light source, by way of a wiring harness 204. The wiring harness 204 includes a plurality of power cables 204*a* joined to a socket portion 204*b*. In this example, the power supply portion 202 includes a support portion 206 which is mounted adjacent the back wall 208 of the housing 210 for contact therewith. The support portion 206 and back wall 208 have aligned first and second cable passages 206*a*, 208*a* (FIG. 21) to receive the power cables 204*a*.

The support portion 206 is movable between a first rest position against the back wall 208 and an extended second position in which a segment of the support portion is displaced from the back wall 208 to permit the power supply portion 202 to be moved relative to the housing 210 during installation at a designated recessed lighting site.

The back wall 208 and the support portion 206 thus form an inner region 212 therebetween (FIG. 20) when the support portion 206 is in the extended position which would otherwise provide access to the cable, thus causing a risk of injury to the installer. To reduce this risk, the support portion 206 includes a guide member 214 adjacent the first passage 206*a*. The guide member 214 is arranged to extend toward or, in some cases through or into, the second cable passage 208*a* to reduce access to the region 212 and thus the power cable 204*a* from the direction of the arrow A in FIG. 20. Thus, the guide member may be seen as a barrier arranged to at least partially interrupt access to the inner region when the support portion is in the second position.

The support portion 206 includes a support plate 216 with the first cable passage 206*a* formed in a central region thereof. The support plate 216 has a peripheral edge 216*a* and the first cable passage 206*a* is open thereto by way of slot 216*b*. The slot 216*b* thus provides a convenient way to deliver the wiring harness 204 to the first cable passage 206*a* without having to disassemble the socket portion 204*b* or requiring the latter to be installed after the power cable 204*a* is located in the first cable passage 206*a*. That being said, the wiring harness 204 may indeed be installed by disassembling the socket portion 204*b* if desired, or by installing the power cable 204*a* first in the first cable passage 206*a* before installing the socket portion thereon. The slot 216*b* may also be configured differently than that shown in the figures. It may instead form a larger access opening directed longitudinally or laterally relative to the first support plate, among other arrangements.

The support plate 216 includes a first pair of fastener passages 216*c* at a first location and a second pair of fastener passages 216*d* at a second location. The first and second fastener passages 216*c*, 216*d* are arranged to receive fasteners therethrough. The second fastener passages 216*d* are in threaded form while the first fastener passages 216*c* are clearance holes which are aligned with corresponding threaded passages 208*d*.

Figure 19:
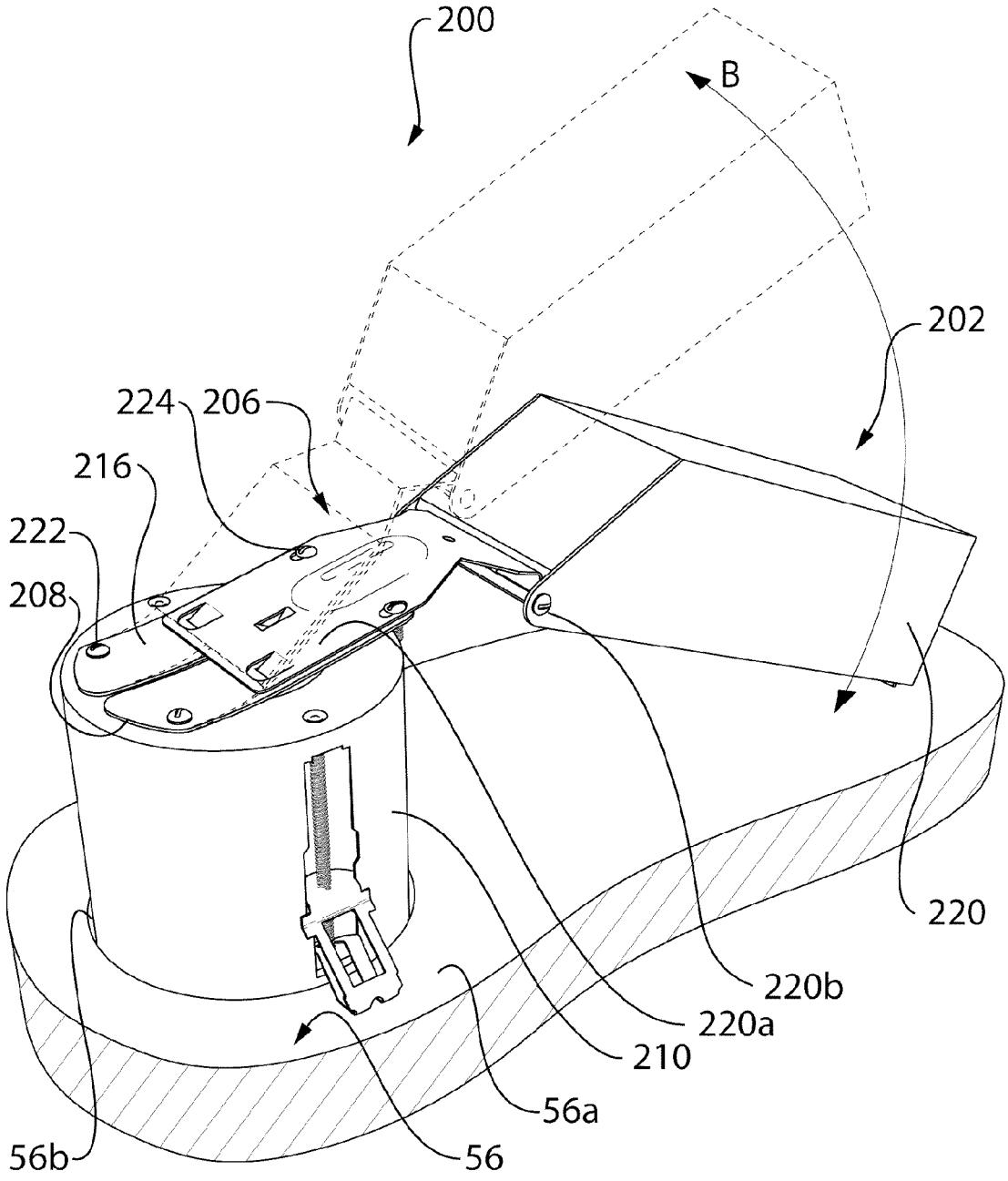
FIG. 19 is a perspective view of another recessed lighting fixture.
Figure 20:
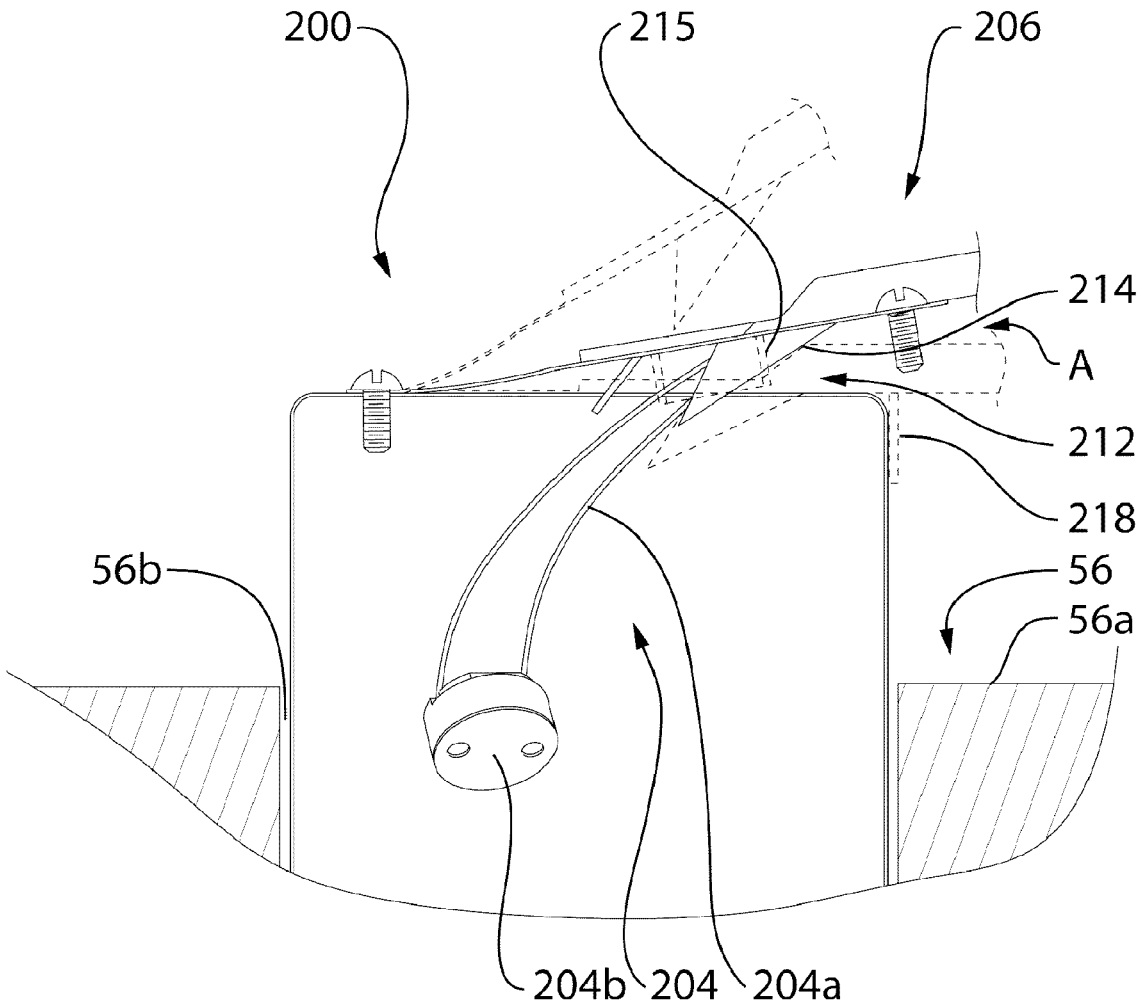
FIG. 20 is a side view of a portion of the fixture of FIG. 19.

Referring to FIG. 19, the power supply portion 202 includes a junction box portion 220 with a mounting plate 220*a* pivotally mounted thereto by way of a pivot member 220*b*. A pair of first fasteners 222 fix the support plate 216 to the back wall 208 through the first passages 216*c* and passages 208*d* at the first location and a pair of second fasteners 224 fix the support plate 216 to the mounting plate 220*a* through the second passages 216*d*.

Figure 21:
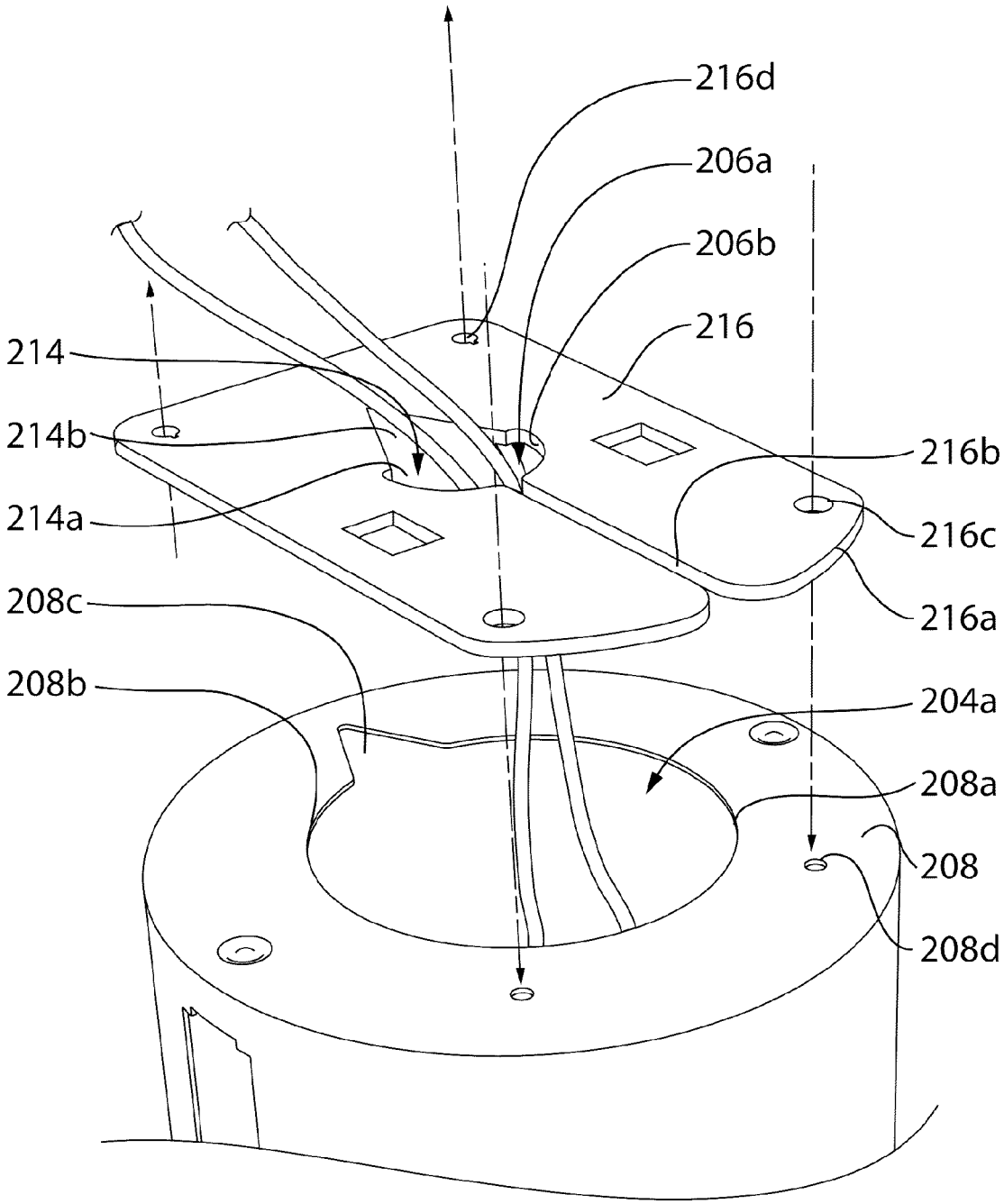
FIG. 21 is a fragmentary perspective assembly view of another portion of the fixture of FIG. 19.

As can be seen in FIG. 21, the first cable passage 206*a* has a boundary region 206*b* and the guide member 214 includes a flange 214*a* extending inwardly from the boundary region 206*b* and toward and/or through the second cable passage 208*a* when the support plate 216 is in both the rest and extended positions.

Figure 22:
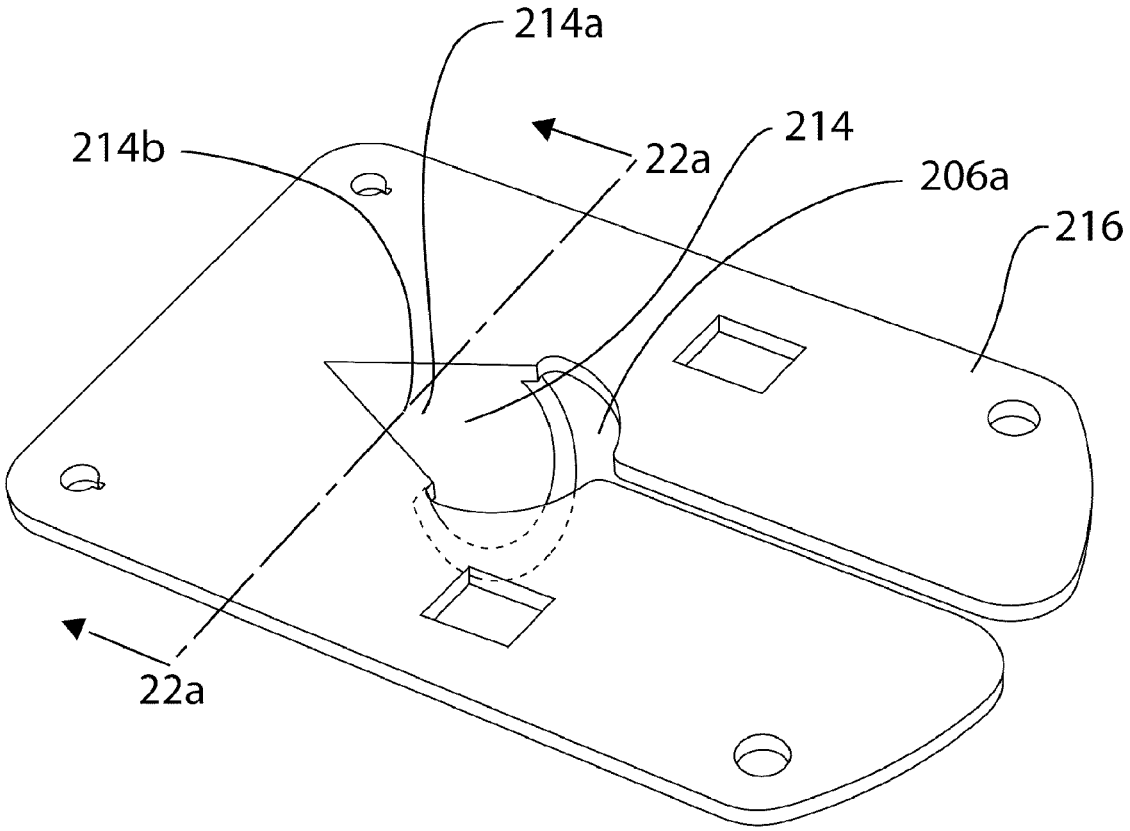
FIG. 22 is a perspective view of a component shown in FIG. 21.
Figure 22A:
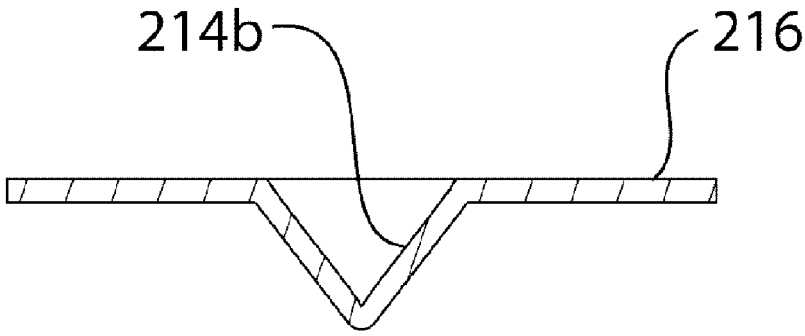
FIG. 22*a* is a sectional view taken on line 22*a*-22*a* of FIG. 22.

In this case, the guide member 214 has a neck portion 214*b* with a v shaped cross section, as shown in FIG. 22*a*. The second cable passage 208*a* has a peripheral region 208*b* and a v-shaped notch 208*c* therein to receive the neck region 214*b* when the support portion 206 is in the rest position. While the flange 214*a* extends toward or into in the second cable passage 208*a* in both the rest and extended positions, there may be cases when the support plate extends to another extended position, such as super extended position, where the flange 214*a* leaves the region of the second passage 208*a*. In this case, the flange 214*a* still offers some measure of a barrier for the power cables 104*a* away via region 212, though the dimensions of the guide member 214 may be adjusted to accommodate a number of extended positions as desired.

The flange 214*a* can be seen to extend partway along the boundary of the first cable passage, for example about 180 degrees along the boundary. However, the flange may, if desired, extend more or less than 180 degrees if desired. For instance, the flange may extend the entire periphery of the passage. In this latter case, then, the flange may be provided in the form of a cylindrical skirt depending from the first cable passage, as shown in dashed lines at 215. In addition, the flange may also, in some cases, be arranged to extend outwardly from the support plate 216 in the vicinity of the first cable passage or in other locations relative thereto. For instance, the flange may extend outwardly from the support plate at a location beyond the periphery of the side wall of the housing, for example as shown by the dashed lines at 218.

There are other ways in which the support plate 216 may be mounted on the back wall. For instance, the support plate may be welded, riveted or bonded to the back wall. A portion of the support plate may be integrally formed with the back wall if desired. The support plate 216 is biased toward the back wall 208 by the natural spring rate of the support plate when fastened to the back wall. The support plate 216 may be provided with other forms of biasing, such as by a pivot connection between the support plate 216 and the back wall, or between two sections of the support plate itself.

Thus, the light fixture 200 is used in the following manner. First, the light fixture may be assembled as described above. Then, with the appropriate passage 56*b* formed in the ceiling panel 56, the light fixture 200 is installed by first directing the power supply portion 202 through the passage 56*a*. To do this, the power supply portion is oriented relative to the housing 210, so that the power supply portion transferred from its lateral position relative to the housing as shown in solid lines in FIG. 19 to a more elongate or inline orientation relative to a central axis of the housing, as shown in dashed lines in FIG. 19, according to the arrow shown at B in FIG. 19. As the power support portion 202 passes through the passage 56*b*, it is directed laterally from the passage 56*b* between the upper surface of the ceiling panel and the adjoining structure of the ceiling (not shown). Meanwhile, the housing 210 is aligned with the passage 56*b* and is then pushed through the passage and then anchored in place in a manner similar to that above described. Thus, the power supply portion 202 and the housing 210 will come to an installed orientation with the support plate 216 being oriented at an angle relative to the back wall 208 depending on the relative position of the power supply portion and the housing. For instance, in situations where the ceiling panel 56 is relatively thick, the power supply portion will be in a raised installed position in comparison with a comparable light fixture installed in a relatively thin ceiling panel 56.

The power supply portion 202 may be provided in different configurations and be coupled with the mounting plate 220*a* and thus to the plate 216 using other configurations. For instance, the mounting plate 220*a* and the support plate 216 may be integrally formed, if desired. The support plate may be coupled to the housing 210 at locations other than the back wall 208.

As can be seen, the side wall of the housing shown above are arranged to form a cylinder, but maybe provided in other configurations, such as multiple sided cross sectioned structures, such as squares, rectangles, triangles and the like. The housing may also be formed of more than one part, as desired. While the lip 18 is shown above integrally formed with the housing 12, but may be separate therefrom and attachable thereto, if desired.

The drive member may be provided in other configurations, such as by way of a spring-loaded pin, for example.

The retaining clips above described include a first movement away from the ceiling or wall panel to release the clip and a second opposite movement toward the panel to tighten the clip against the ceiling or wall panel. However, the clip may be arranged to provide the release function and the tightening function in the same direction if desired.

While the recessed lighting fixture 10 is described with respect to its installation in a ceiling panel, the fixture, if desired, may also be mounted in other panels that are not necessarily ceiling panels in some cases. For instance, the fixture may be installed a wall panel or a floor panel. Moreover, the housing described herein may be used to mount articles other than light fixtures onto panels, including ceiling, wall and floor panels, or other panels, for that matter.

The retaining clip, in some cases, may also be retained as described by using only one slot extension or lateral slot formation and one corresponding arm or body portion, and/or one retaining region, rather than the opposed pair configurations as described above.

The head, neck and body portions 34, 36 and 38 provide one configuration of the first, second and third portions. Other configurations may also be used if desired without having the features associated with the head, neck and body portions as described above. In addition, the spring-loaded, while the body portion is shown above slightly bowed in light of this spring-loaded orientation. There may be other examples in which the body portion may be spring loaded without being bowed in the manner illustrated above. Furthermore, other means may be provided for biasing the body portion outwardly from the housing, in addition to or as an alternative to, the inherent resiliency to the body portion.

While the present invention has been described for what are presently considered the preferred embodiments, the invention is not so limited. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

The invention claimed is:

1. A mounting device for mounting an article in passage formed in a wall panel, said mounting device having a housing with one or more side walls, one or more of which including at least one elongate slot formation, the slot formation including a pair of oppositely extending lateral edge formations, the slot formation having a first dimension, a retaining clip to be located in the slot formation for movement therealong, the retaining clip having a first portion to extend through the slot formation and to travel along an inner surface of the corresponding side wall on opposite sides of the slot formation, a second portion having a second dimension exceeding the first dimension and to travel along an outer surface of a corresponding side wall on opposite sides of the slot formation, the second portion being arranged to extend outwardly from the housing relative to the first portion, the second portion joined to a third portion, the third portion being arranged to extend through the slot formation in a retained position, in which the third portion is retained against an inner surface of the corresponding lateral edge formation with the second portion in a spring-loaded orientation, the third portion being movable from the retained position to a released position when separated from the lateral edge formation through a slot extension, thereby causing the second portion to be transferred from its spring-loaded orientation to an outwardly extended orientation relative to the housing, wherein said first portion and said second portion have a dimension greater than said slot extension, both said first and said second portion able to traverse said slot extension of said elongate slot formation.

2. A recessed lighting fixture, comprising a housing having a back wall, one or more side walls extending from the back wall and at least one lower lip extending outwardly from one of said side walls, one or more of said side walls including at least one elongate slot formation extending along an axis substantially perpendicular to the back wall, the slot formation including a pair of oppositely extending lateral slot extensions, each slot extension having a first dimension, a retaining clip to be located in the slot formation for movement therealong, the retaining clip having a head portion, a neck portion and a body portion, the neck portion being dimensioned to extend through the slot formation and the head portion arranged to travel along an inner surface of the corresponding side wall on opposite sides of the slot formation, the body portion including a pair of arm portions adjacent the neck portion and extending outwardly therefrom, each arm portion having a second dimension exceeding the first dimension to permit the arm portions to travel along an outer surface of a corresponding side wall and over the corresponding lateral slot extension, the body portion arranged to be biased outwardly from the housing, the body portion joined to an anchor portion, the anchor portion being arranged to extend through the slot formation, the anchor portion including a pair of opposed abutment portions, each abutment portion being arranged to travel along an inner surface of the corresponding side wall on opposite sides of the slot formation, the abutment portions being dimensioned to pass through a corresponding slot extension to transfer the clip between locked and unlocked orientations when a displacement rod, extending through said clip, is pressed into said housing releasing said abutment portions of said clip from said lateral slot extensions.

3. A recessed lighting fixture, comprising a housing having a back wall, one or more side walls extending from the back wall, one or more of said side walls including at least one elongate slot extending along the back wall, the slot including a pair of oppositely extending lateral edges, each slot having a first dimension, a retaining clip to be located in the slot for movement therealong, the retaining clip having a first portion which is dimensioned to extend through the slot and to travel along an inner surface of the corresponding side wall on opposite sides of the slot, a second portion having a second dimension exceeding the first dimension and arranged to travel along an outer surface of a corresponding side wall on opposite sides of the slot, the second portion being arranged to be biased outwardly from the housing relative to the first portion, the second portion joined to a third portion, the third portion being arranged to extend through the slot and arranged to be retained against an inner surface of the corresponding lateral edge with the second portion in a spring loaded orientation, the third portion being moveable from the retained position to a released position when separated from the lateral edge by a slot extension, thereby causing the second portion to be transferred from its spring-loaded position to an outwardly extended position relative to the housing, said first portion sized to travel over said slot extension when said retaining clip travels along said slot.

4. A recessed lighting fixture, comprising a housing having a back wall and one or more side walls extending from the back wall, one or more of said side walls including at least one elongate slot extending along an axis substantially perpendicular to the back wall, the slot including a pair of oppositely extending lateral slot extensions, each slot extension having a first dimension, a retaining clip to be located in the slot for movement therealong, the retaining clip having a head portion, a neck portion and a body portion, the neck portion being dimensioned to extend through the slot and the head portion arranged to travel along an inner surface of the corresponding side wall on opposite sides of the slot, the body portion including a pair of peripheral regions adjacent the neck portion and extending outwardly therefrom, each peripheral region having a second dimension exceeding the first dimension to permit the peripheral region to travel along an outer surface of a corresponding side wall and over the corresponding lateral slot extension, the body portion arranged to be biased outwardly from the housing, the body portion joined to an anchor portion, the anchor portion being arranged to extend through the slot formation, the anchor portion including a pair of opposed locking flanges, each locking flange being arranged to travel along an inner surface of the corresponding side wall on opposite sides of the slot, the locking flanges being dimensioned to pass through a corresponding slot extension to transfer the clip between locked and unlocked orientations when a screw fastener extending through said clip is pushed in an orientation substantially parallel to said elongate slot.

* * * * *